US011865600B2

(12) United States Patent
Pilon et al.

(10) Patent No.: US 11,865,600 B2
(45) Date of Patent: Jan. 9, 2024

(54) IMPACT EXTRUSION METHOD, TOOLING AND PRODUCT

(71) Applicants: MONTEBELLO TECHNOLOGY SERVICES LTD., Vancouver (CA); 1949467 ONTARIO INC., Kingston (CA)

(72) Inventors: Betty Jean Pilon, Vankleek Hill (CA); Peter Stathopoulos, Roxboro (CA); Georgi Georgiev, Toronto (CA); Benjamin Joseph Pilon, Inverary (CA)

(73) Assignees: MONTEBELLO TECHNOLOGY SERVICES LTD., Vancouver (CA); 1949467 ONTARIO INC., Kingston (CA)

( * ) Notice: Subject to any disclaimer, the term of this patent is extended or adjusted under 35 U.S.C. 154(b) by 0 days.

(21) Appl. No.: 17/860,362

(22) Filed: Jul. 8, 2022

(65) Prior Publication Data

US 2022/0347731 A1 Nov. 3, 2022

Related U.S. Application Data

(60) Division of application No. 16/055,404, filed on Aug. 6, 2018, now Pat. No. 11,383,281, which is a (Continued)

(51) Int. Cl.
*B21C 23/18* (2006.01)
*B21C 26/00* (2006.01)
(Continued)

(52) U.S. Cl.
CPC ..... *B21C 23/18* (2013.01); *B21C 23/186* (2013.01); *B21C 25/04* (2013.01); *B21C 26/00* (2013.01);
(Continued)

(58) Field of Classification Search
CPC ..... B21C 23/00; B21C 23/16; B21C 23/186; B21C 26/00
See application file for complete search history.

(56) References Cited

U.S. PATENT DOCUMENTS 2,756,876 A 7/1956 Watson et al.
2,904,173 A 9/1959 Braun et al.
(Continued)

FOREIGN PATENT DOCUMENTS

CA 2445582 A1 11/2002
CN 103624502 A 3/2014
(Continued)

OTHER PUBLICATIONS

International Search Report and Written Opinion for Application No. PCT/CA2015/051378, dated Mar. 15, 2016, 12 pages.
(Continued)

*Primary Examiner* — Teresa M Ekiert
(74) *Attorney, Agent, or Firm* — Crowell & Moring LLP; John C. Freeman

(57) ABSTRACT

A hollow preform impact extruded from a metal billet to produce a progressing wall at a transition wall thickness. An axially forward portion of the progressing wall is ironed by extrusion past an extrusion point to form a sidewall portion of a lesser thickness. Extruding is stopped while some of the billet remains to form the closed bottom end. The preform has a bottom portion, a sidewall portion and a transition wall portion extending between the bottom portion and the sidewall portion. The transition wall portion is thicker than the sidewall portion and can be formed into at least part of the rim of an expansion shaped container. An impact extrusion punch has a central axis, an axially forward, impact surface for impacting metal to be extruded, a transition region for directing material displaced by the impact surface and a rear
(Continued)

extrusion point for ironing material extruded past the transition region.

18 Claims, 23 Drawing Sheets

Related U.S. Application Data continuation of application No. 14/983,025, filed on Dec. 29, 2015, now abandoned.

(60) Provisional application No. 62/097,821, filed on Dec. 30, 2014.

(51) Int. Cl.

| | |
|---|---|
| ***B21D 26/049*** | (2011.01) |
| ***B21C 25/04*** | (2006.01) |
| ***B65D 1/02*** | (2006.01) |
| ***B65D 1/16*** | (2006.01) |
| ***B65D 1/40*** | (2006.01) |

(52) U.S. Cl.

CPC ..... *B21D 26/049* (2013.01); *B65D 1/0261* (2013.01); *B65D 1/165* (2013.01); *B65D 1/40* (2013.01)

(56) References Cited

U.S. PATENT DOCUMENTS

| | | | |
|---|---|---|---|
| 3,263,468 | A | 8/1966 | Rowell |
| 3,738,528 | A | 6/1973 | Kagami |
| 4,294,373 | A | 10/1981 | Miller |
| 4,402,419 | A | 9/1983 | MacPherson |
| 5,058,408 | A | 10/1991 | Leftault, Jr. et al. |
| 5,214,258 | A | 5/1993 | Akers |
| 5,261,558 | A | 11/1993 | Claydon |
| 5,377,518 | A | 1/1995 | Abbott |
| 5,542,277 | A | 8/1996 | Dunwoody |
| 5,570,806 | A | 11/1996 | Abbott |
| 5,611,454 | A | 3/1997 | Abbott |
| 5,776,270 | A | 7/1998 | Biondich |
| 5,832,766 | A | 11/1998 | Hartman et al. |
| 5,992,197 | A | 11/1999 | Freeman et al. |
| 6,349,583 | B1 | 2/2002 | Kleinschmidt et al. |
| 6,349,586 | B1 | 2/2002 | Johnson et al. |
| 6,387,198 | B1 | 5/2002 | Suzuki et al. |
| 6,802,196 | B2 | 10/2004 | Gong et al. |
| 6,945,085 | B1 | 9/2005 | Goda |
| 7,107,804 | B2 | 9/2006 | Gong et al. |
| 7,117,704 | B2 | 10/2006 | Ogura et al. |
| 7,191,032 | B2 | 3/2007 | MacEwen et al. |
| 7,291,817 | B2 | 11/2007 | Weiss et al. |
| 8,683,837 | B2 | 4/2014 | Mallory et al. |
| 8,899,085 | B2 | 12/2014 | Adams et al. |
| 9,943,899 | B2 | 4/2018 | Pilon et al. |
| 11,040,387 | B2 | 6/2021 | Pilon et al. |
| 11,383,281 | B2 | 7/2022 | Pilon et al. |
| 2002/0162371 | A1 | 11/2002 | Hamstra et al. |
| 2005/0005665 | A1 | 1/2005 | Ogura |
| 2006/0060115 | A1 | 3/2006 | Hagino |
| 2006/0260115 | A1 | 11/2006 | Otake |
| 2009/0274957 | A1 | 11/2009 | Goda et al. |
| 2011/0113732 | A1 | 5/2011 | Adams et al. |
| 2011/0167886 | A1 | 7/2011 | Mallory et al. |
| 2013/0167607 | A1 | 7/2013 | Adams et al. |
| 2016/0256910 | A1 | 9/2016 | Niec et al. |

FOREIGN PATENT DOCUMENTS

| | | | |
|---|---|---|---|
| DE | 1452509 | A1 | 3/1969 |
| DE | 102009008137 | A1 | 7/2010 |
| EP | 0852973 | A1 | 7/1998 |
| EP | 2859966 | A1 | 4/2015 |
| GB | 803015 | A | 10/1958 |
| JP | S35-1368 | A | 2/1960 |
| JP | S5187162 | A | 7/1976 |
| JP | S 59 66917 | A | 4/1984 |
| JP | S5956104 | U | 4/1984 |
| JP | S 6255937 | B2 | 11/1987 |
| JP | 2002-079324 | A | 3/2002 |
| JP | 2005009673 | A | 1/2005 |
| WO | WO 02/087802 | A1 | 11/2002 |
| WO | WO 2009/019841 | A1 | 2/2009 |
| WO | WO 2013/040339 | A1 | 3/2013 |
| WO | WO 2015/054284 | A2 | 4/2015 |

OTHER PUBLICATIONS

International Preliminary Report on Patentability for Application No. PCT/CA2015/000180, dated Oct. 6, 2016, 8 pages.

International Search Report and Written Opinion for Application No. PCT/CA2015/000180, International Search Report and Written Opinion dated Jul. 21, 2015, 10 pages.

International Patent Application No. PCT/CA2015/051378, International Preliminapy Report on Patentability dated Mar. 30, 2017, 3 pages.

European Patent Application No. 15769617.0 Supplementary Partial European Search dated Dec. 14, 2017.

Office Action dated Feb. 7, 2017 for U.S. Appl. No. 14/667,139, 30 pages.

Response to Written Opinion filed Oct. 26, 2016 for International Patent Application No. PCT/CA2015/051378, 21 pages.

Ceretti et al., "Aluminium Can Shaping by Hydroforming: Simulative Feasibility Study and Prototype Production," The International Journal of Advanced Manufacturing Technology, Apr. 2013, vol. 68 (5-8), pp. 1797-1807.

Company Coca Cola: "Timeline: The Evolution of the Coca-Cola Bottle," Dec. 2008. [retrieved on Apr. 16, 2018] Retrieved from the Internet: URL:[http://www.coca-colacompany.com/chronology].

European Patent Application No. 15874439.1, Extended European Search Report dated Oct. 16, 2018, 13 pages.

European Patent Application No. 15769617.0, Extended European Search dated May 4, 2018, 15 pages.

European Patent Application No. 15874439.1, Partial Supplementary European Search Report dated Jul. 11, 2018, 15 pages.

Pat Reynolds., "Coca-Cola Masters ROPP Cap on Aluminum Bottle," Aug. 2014. [retrieved on Apr. 16, 2018] Retrieved from the Internet:URL:[https://www.packworld.com/article/machinery/fillingsealing/capping/coca-cola-masters-ropp-cap-aluminum-bottle].

Shi et al., "Numerical Simulation of the Pressure Ram Forming Process," Journal of Materials Processing Technology, vol. 182 (1-3), Nov. 2006, pp. 411-417.

Communication dated Aug. 8, 2019 (four-pages in foreign text) from Brazilian Patent Application 112016021973.

Notice of Reasons for Rejection and translation for JP 2017-535809, dated Dec. 2, 2019, 10 pp.

English-language translation of Japanese Patent Publication JP S 35-1368.

European Application No. 15874439.1, Communication pursuant to Article 94(3), dated Oct. 20, 2020 (4 pages).

Japanese Patent Application No. JP2017-535809, Decision of Rejection dated Oct. 5, 2020—English Translation Available (11 pages).

Japanese Patent Application No. 2021-017044, Office action dated Oct. 26, 2022 (5 pages); English Translation Not available.

Japanese Patent Application No. 2017-535809, Office action dated Dec. 13, 2021 (7 pages including English Translation).

Japanese Patent Application No. 2021-017044, Office action dated Jan. 12, 2021 (6 pages including English Translation).

Korean Patent Application No. 10-2017-7021172, Office Action dated Sep. 7, 2022 (14 pages including English Translation).

Korean Patent Application No. 10-2017-7021172, Office Action dated Jan. 3, 2022 (16 pages including English Translation).

Mexican Patent Application No. MX/a/2017/008619, Office Action dated Mar. 9, 2022 (6 pages); English Translation Not Available.

Mexican Patent Application No. MX/a/2017/008619, Office Action dated Sep. 21 , 2022 (4 pages) English Translation Not Available.

(56) References Cited

OTHER PUBLICATIONS

U.S. Appl. No. 16/055,404, Advisory Action dated Jan. 20, 2022 (3 pages).
U.S. Appl. No. 16/055,404, Final Office Action dated Sep. 8, 2021 (12 pages).
U.S. Appl. No. 16/055,404 Notice of Allowance dated Mar. 15, 2022 (9 pages).

IMPACT EXTRUSION METHOD, TOOLING AND PRODUCT

This application is a divisional application of U.S. patent application Ser. No. 16/055,404, filed on Aug. 6, 2018, which is a continuation application of U.S. patent application Ser. No. 14/983,025, filed on Dec. 29, 2015, which claims priority from U.S. Provisional Application No. 62/097,821, filed on Dec. 30, 2014 and entitled Impact Extrusion Tooling, the entire contents of each of which are incorporated herein by reference in their entirety.

FIELD OF THE INVENTION

The invention relates to the metal working field, more particularly to cold formed metal products and to a method and tooling for forming such metal products by impact extrusion.

BACKGROUND OF THE INVENTION

Shaped metal containers can be manufactured from sheet materials by drawing and forming of the sheet material into the finished shape. Expansion-shaped metal containers are usually manufactured by molding a tubular preform with a pressurized fluid. The preform can be made by drawing of a sheet material or by impact extrusion of a metal slug or billet. The sheet material or slug is shaped or extruded into the preform which is then shaped and expanded into the expanded container.

Impact extrusion is a process in which a metal blank is impacted at such force that the metal is transformed into a plastic state in which the metal will actually flow. Impact extrusion is a type of specialty cold forming used for metal products with hollow cores and relatively small wall thicknesses. The impact extrusion process begins with a metal blank that is placed in a die that is located on a mechanical or hydraulic press. A punch driven into the die by the force of the press causes the metal blank to flow (extrude) into the die shape and around the punch in a forward manner (into the die), in a backward manner (around the punch), or both. In backward extrusion, the metal of the slug flows backward from the slug to form the sidewalls of a thin-walled tube having an open and a closed end. After forming of the sidewalls, the remainder of the slug forms the closed end of the tube and the punch is removed through the open end. Impact extruded tubes can be used in packaging applications, as housings for writing implements, etc. Recently, such containers have also been used as preforms for expansion shaped containers.

U.S. Pat. No. 2,904,173 discloses a plunger and die for impact extrusion of a metal billet.

U.S. Pat. No. 3,263,468 discloses a method and apparatus for extruding tubes from billets wherein the resultant tube has a larger inside diameter than the diameter of the mandrel about which it is extruded and has a tubular wall of relatively uniform thickness. The flow of the metal is controlled so that it (flows) extrudes outwardly and away from the mandrel against a die surface. A tube having an inside diameter larger than the diameter of the mandrel is thereby formed. Owing to the fact that the inside diameter of the extruded tube is larger than that of the mandrel, there is no binding of the tube on the mandrel and the tube can therefore be quickly and more easily removed.

U.S. Pat. Nos. 5,611,454, 5,377,518 and 5,570,806 disclose apparatus for forming extruded cylindrical closed-ended metal tubes having a flat closed end wall and an integrally formed tubular projection on the closed end. The apparatus includes a die having a recess with a configuration, which corresponds to the terminal end portion of the desired tube and includes a cavity, which corresponds to the desired projection. The apparatus further includes a punch, which is receivable in the die, and includes an end wall having a peripheral portion, which extends angularly outwardly at an angle of between approximately 10 degrees relative to a plane perpendicular to the longitudinal axis of the die. The apparatus is operated by placing an extrudable metal disc in the recess in the die and advancing the punch into the recess with sufficient force to extrude metal from the disc forward into the cavity and also backward between the punch and the die to form the desired tube.

All of the above methods and apparatus produce hollow tubes having a closed end and a tubular wall of constant wall thickness. Such hollow tubes can be used as preforms in fluid pressure forming processes for the manufacture of expansion shaped metal containers. However, the constant wall thickness of the tubular wall creates some challenges during expansion shaping, as does the change in direction, and generally also thickness, at the juncture of the closed end with the sidewall.

The shaping of an expanded metal container can include one or more forming steps, such as drawing or extruding, necking, rolling, ironing, fluid pressure molding, threading, etc.

One type of expansion shaping is the fluid pressure molding method known as pressure ram forming and disclosed in U.S. Pat. No. 7,107,804. In that process, a metal container of defined shape and dimensions is formed both by applied internal fluid pressure and by the translation of a ram. A hollow metal preform having a closed end is placed in a die cavity which is enclosed by a die wall defining the shape and lateral dimensions of the expanded container. A ram located at one end of the die cavity is translatable into the cavity. The preform is positioned in the die with the closed end positioned opposite the ram. The preform is initially spaced inwardly from the die wall. Upon being subjected to internal fluid pressure, the preform expands outwardly into substantially full contact with the die wall. This imparts the defined shape and lateral dimensions of the die cavity onto the preform. After the preform begins to expand, but before expansion of the preform is complete, the ram is translated into the cavity to engage and displace the closed end of the preform in a direction opposite to the direction of force exerted by the internal fluid pressure. This translation of the ram causes the ram to inwardly dome the closed end of the preform. The defined shape, into which the container is formed, may be a bottle shape including a neck portion, a body portion larger in lateral dimensions than the neck portion and a concave, inwardly domed bottom. The concave container bottom created by the ram provides the container with additional pressure capacity, since it enables the container to withstand a higher internal pressure without unwanted deformation, especially of the bottom end.

After the container has been expanded, the open end may be shaped into a tapered neck, and a closure applied to the container top end (e.g. a dispensing or spray valve, or a closure cap).

Shaped, expanded metal containers made by fluid pressure forming processes require expandable preforms. Conventional expandable preforms for use in pressure forming processes usually include a closed end and a tubular wall extending from the closed end.

As mentioned above, the tubular wall of conventional impact extruded preforms has a generally constant thickness starting at the closed end. The closed end usually has a larger thickness than the tubular wall and, due to the differences in material thickness, the tubular wall generally has a much lower bending resistance than the closed end. During pressure expansion of the preform, the sidewall expands radially outward. In the bottom forming process involving the ram, the preform closed end is deformed axially upward, but not radially outward, leading to a decreased diameter. Thus, when the closed end of the preform is domed by the ram in the pressure ram forming process, the lower end of the sidewall is rolled inward to form a rolled-in rim section which bridges between the now domed (concave) bottom end and the expanded sidewall of the container. The circumferential rim section merges with the sidewall and forms an annular base for supporting the container. The combined effect of smaller wall thickness in the rim section, compared to the bottom section, and increased bending stress at the rim section creates an annular region of weakness at the rim section. This may cause container failure in this region upon pressurization of the container. In particular the manufacture of aerosol containers may be a challenge with this method, since the elevated internal pressure in an aerosol container, compared to a carbonated beverage container, may lead to excessive stress in the rim section and, thus, to container failure initiating at the rolled-in rim.

Shaped packaging containers intended to withstand internal pressures generally require a relatively thick container bottom, or a bottom which is domed inward, or both. The inwardly domed bottom end is the most commonly used shape for pressurized containers, since it allows the use of thinner material in the domed section, compared to flat bottom containers, making a container with domed bottom more economical. During shaping of the container, the portions of the preform that are transformed into the domed bottom and rim section of the expanded container are subjected to bending and/or expansion stresses. Moreover, in the finished, shaped and expanded container, the rim section is subjected to additional bending stress upon pressurization of the container. Due to their respective shape and the direction of force acting on them during pressurization, the domed bottom has a higher bending resistance than the rolled-in rim section. Excessive pressurization of the container will create an outward force on the domed section, leading to an unrolling of the rim section, once the pressure resistance limit of the container at the rim section has been exceeded.

During pressure testing of carbonated beverage containers, the height of the container is monitored. In order to successfully pass the pressure test, the container height cannot increase under pressure. Due to the geometry of the container bottom, deformation of the container under increased pressures generally starts with an unrolling of the rim section in a sequence opposite to that occurring during pressure ram forming. First the inner half of the rim section, the one extending between the domed bottom and the peak of the rim, is unrolled and subsequently flattening of the domed bottom occurs, generally at or near the rim section. This phenomenon may be explained by the larger thickness of the bottom as well as the inwardly domed shape of the bottom. Thus, even if the mounting internal pressure does not lead to immediate failure of the container wall, the pressure acting on the container bottom will cause a rolling out of the rim section, which in turn increases the height of the container. Consequently, even though the testing pressure does not lead to a container rupture in that situation, the container will fail the pressure test, due to the increase in container height.

Although preforms with a larger sidewall thickness could be used to increase the pressure capacity and shape stability of the container, the overall significantly lower deformability of such thicker sidewalls may render the preform unsuitable for shaping and expansion in a fluid pressure forming process. Moreover, the increased amount of material used may render the container uneconomical and unacceptable to the purchaser.

In preforms made by impact extrusion, the tubular wall can be extruded at close to the desired final thickness of the container sidewall, taking into consideration a slight thinning which occurs during radial expansion. However, the closed end is generally thicker than the sidewall. This leads to a stress point at the juncture of the tubular wall and the closed end during sidewall expansion and closed end deformation. Moreover, due to the higher outer diameter of the finished shaped container and the significantly different thickness and associated higher bending resistance of the closed bottom end of the preform, the bottom end becomes the dome forming portion of the preform and a bottom end of the tubular wall is rolled inward to form the rim section of the container. The rim forming section bridges the radial space between a radially outer edge of the closed and domed bottom end and the expanded sidewall having a larger diameter than the outer edge of the domed bottom. Therefore, the rim section in the finished, expansion shaped container is formed by a rim forming portion which was initially an integral part of the tubular wall of the preform. Thus, if this rim portion in the expanded container, which originates from a rim forming portion of the tubular wall in the preform, is to have a certain thickness, the whole tubular wall would need to have sufficient thickness to form the rim section in the expanded container. However, that means the sidewall in the expanded, shaped container would be of the same thickness as the rim section, leading to the associated shaping challenges and economical disadvantages discussed above.

Preforms with sidewalls of variable thickness, when originating from impact extruded products, currently require the use of metal working processes separate from and in addition to the impact extrusion process, for example ironing or rolling, if the thickness of the impact extruded sidewall is to be reduced in select areas.

SUMMARY OF THE INVENTION

It is an object of the invention to overcome at least one of the disadvantages found in the prior art. In particular, it is one object to provide preforms with a sidewall of variable thickness. It is another object to provide a single operation impact extrusion method for the manufacture of such a preform and a further object to provide tooling to carry out the method.

In a first aspect, the invention provides a method of impact extruding a hollow preform including a closed bottom end and a tubular wall, the tubular wall having portions of differing wall thickness and defining a longitudinal axis of the preform. The method includes the steps of impacting a metal billet for plasticizing the metal and redirecting the plasticized metal for forming an axially progressing tubular wall at a transition wall thickness; and ironing an axially forward portion of the progressing wall by extruding the forward portion past an extrusion point to form a sidewall portion of a reduced sidewall thickness. The ironing step preferably includes ironing the progressing tubular wall on a radially inner surface by pushing the forward portion past the extrusion point to form a sidewall portion having a sidewall thickness smaller than the transition wall thickness. The impacting process is stopped while some of the billet remains to form the closed bottom end and the tubular wall. By ironing the progressing wall, a preform is formed which includes the bottom end, the sidewall portion of reduced wall thickness and a transition wall portion having the transition wall thickness and extending between the bottom end and the sidewall portion.

In one embodiment, the metal billet is extruded past a forward extrusion point to form the bottom end and the transition wall portion. In another embodiment, the impact extruding is stopped when the billet is reduced to a bottom wall thickness larger than the transition wall thickness, to form the bottom end. In a further embodiment, the impact extruding is stopped when the billet is reduced to a bottom wall thickness equal to or smaller than the transition wall thickness, to form the bottom end.

In still further embodiments, the ironing of the first sidewall portion is commenced after an axial progression of the progressing wall of about 5 mm to about 15 mm, about 6 mm to about 10 mm, about 7 mm to about 9 mm, about 9 mm, or about 7 mm.

In a second aspect, the invention provides an impact extrusion punch for insertion into an extrusion die. The punch has a body with a central axis, an axially forward, impacting end and an axially rearward, driven end for attachment to a press. The impacting end includes an impact surface for impacting a metal billet to be extruded and a transition region rearward from the impacting end for redirecting material displaced by the impact surface. The punch further includes a rear extrusion point for ironing material extruded past the transition region, the rear extrusion point being adjacent a rearward end of the transition region.

In one embodiment, the impact extrusion punch further includes a forward extrusion point formed by a peripheral shoulder of the impact surface. In this embodiment, the transition region forms a land portion extending rearward from the peripheral shoulder.

In a further embodiment, the land portion is positioned closer to the axis at the rearward end than at the peripheral shoulder.

In another embodiment, the land portion has an axial width equal to about 3% to about 40% of a spacing of the land portion from the axis.

In still another embodiment, the rear extrusion point includes an extrusion shoulder for ironing the material extruded past the transition region, the extrusion shoulder being spaced further from the axis than the transition region. In still a further embodiment, the transition region extends at an angle of about 10 degrees to about 40 degrees to a central axis of the punch.

In a third aspect, the invention provides an impact extruded hollow preform for an expansion shaped container having a bottom, a rim and a sidewall. The preform of the invention has a closed end and a tubular wall defining a longitudinal axis of the preform. The closed end has a bottom forming portion with a bottom wall thickness and the tubular wall has a sidewall forming portion with a sidewall thickness. In addition, the preform has a rim forming portion positioned intermediate the bottom and sidewall forming portions. The rim forming portion includes a transition wall having a transition wall thickness and located adjacent the bottom forming portion. The transition wall thickness is larger than the sidewall thickness.

In one embodiment, the transition wall thickness is smaller than the bottom wall thickness.

In another embodiment, the transition wall thickness is larger than the bottom wall thickness.

In an alternate embodiment, the transition wall thickness is about equal to the bottom wall thickness.

In a further embodiment, the rim forming portion is of constant or variable thickness in circumferential direction, and the average transition wall thickness is larger than the thickness of the sidewall forming portion.

In still a further embodiment of the hollow preform, the bottom wall thickness is larger than the transition wall thickness and the sidewall thickness is smaller than the transition wall thickness. The transition wall thickness may be up to twice the sidewall thickness. The transition wall in the rim forming portion can be part of the closed end, part of the tubular wall, or part of both the closed end and the tubular wall. In still another embodiment, the transition wall is part of the tubular wall and extends from the closed end to a width of about 5% to about 55% of the spacing of the transition wall from the central axis. In further embodiments of the preform, the width is about 15% to about 25%, or about 20%.

BRIEF DESCRIPTION OF THE DRAWINGS

Exemplary embodiments of the invention will be further discussed in detail below with reference to the drawings, wherein.

DESCRIPTION OF EXEMPLARY EMBODIMENTS

Figure 1C:
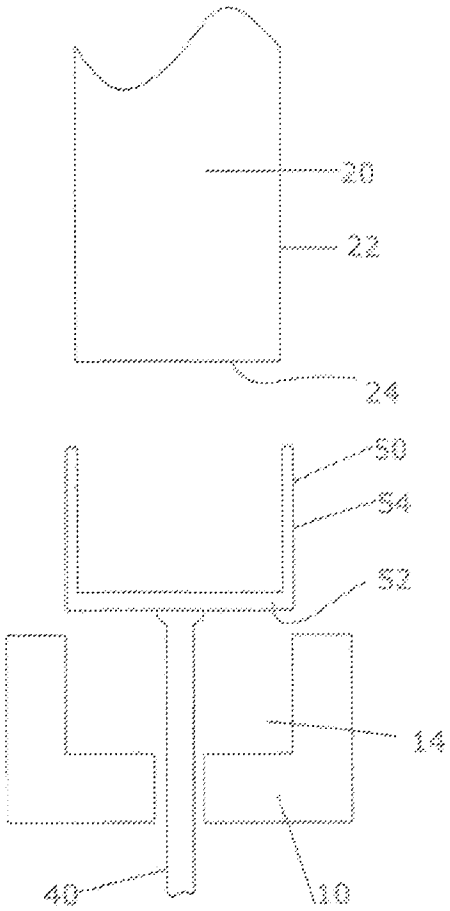
FIG 1C PRIOR ART
FIGS. 1A, 1B and 1C are schematic illustrations of different steps in a conventional impact extrusion process.

This disclosure pertains to expandable hollow metal preforms for the manufacture of expanded shaped metal containers and to a method and tooling for the manufacture of the preform. In particular, this disclosure relates to impact extruded metal preforms for use in a fluid pressure forming process, preferably a pressure ram forming process. This disclosure further relates to an impact extrusion method for making impact extruded preforms and to tooling for such a method.

In this specification, the term impact extruding refers to the process of plasticizing and deforming of metal using an impacting force. Impact extruding as used in the present specification includes impacting metal at such force that it is transformed into a plastic state (plasticized) and urged by the impacting force to flow away from the impact location.

The term impact extrusion used in the present specification refers to a metal cold forming process in which a metal blank or billet is impacted in a die by a punch at sufficient force to cause the metal to plasticize and flow between the punch and the die. Controlling flow of the metal between the punch and the die may involve the use of a localized constriction of the spacing between the punch and the die. Exemplary constrictions are extrusion points or extrusion shoulders. However, the use of a constriction is not essential for the basic impact extrusion process of the invention which includes in its basic form impact plasticizing the metal of the blank and forcing it to flow around the impacting punch prior to an ironing step in accordance with the invention.

The term ironing as used in the present specification defines a process of thinning a metal layer or wall advancing between the die and punch during impact extruding by forcing the advancing metal layer or wall past a constriction, such as an extrusion point or extrusion shoulder.

The terms extrusion point and extrusion shoulder as used in the present specification refer to a circumferential protrusion on the punch that creates a constriction between the punch and the die wall. The extrusion point may be in the form of a ridge, for example an annular ridge in a punch of circular cross-section.

The ironing of sheet metal can be incorporated into a deep drawing process or can be performed separately. In deep drawing, a punch and die push the part through a restriction that acts on an exterior, or radially outer wall of the workpiece to reduce the entire wall thickness to a certain value. The term interior ironing as used in the present specification defines ironing of a tubular wall on a radially inner surface of the wall to generate an increase in the radially inner diameter of the tubular wall, rather than on the outside of the wall, as in known processes. Furthermore, the interior ironing in accordance with the present invention is carried out during and as part of the impact extruding operation rather than in a separate manufacturing step, as in deep drawing.

Although the exemplary preforms illustrated are of generally cylindrical shape and circular cross-section, the present invention applies equally to tubular preforms of any other desired cross-section. Regular or irregular cross-sections are possible, for example elliptical or multi-sided cross-sections.

Conventional Impact Extrusion

The principal steps of a conventional impact extrusion process and the principal tooling components of such a process are discussed with reference to FIGS. 1A to 1C. A standard beverage container with domed bottom end is discussed with reference to FIG. 2. Exemplary preforms in accordance with the invention are discussed with reference to FIGS. 3 to 6. Exemplary preforms with added centering structures for use in a pressure ram forming process are discussed with reference to FIGS. 11 and 12. An exemplary tooling for use in manufacturing a preform with variable tubular wall thickness is shown in FIGS. 13-20. Finished, expanded containers made from the preforms of FIGS. 3-6 are shown in FIGS. 7-10.

Figure 1B:
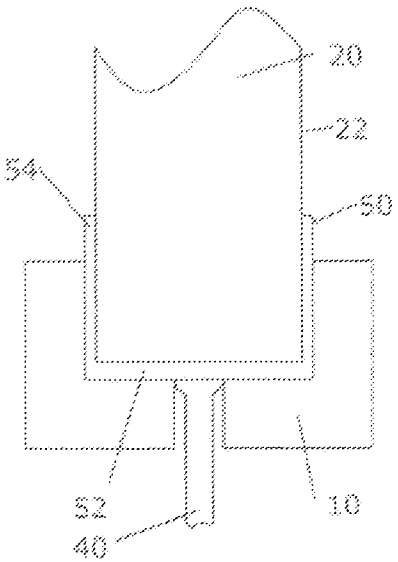
FIG 1B PRIOR ART
Figure 1A:
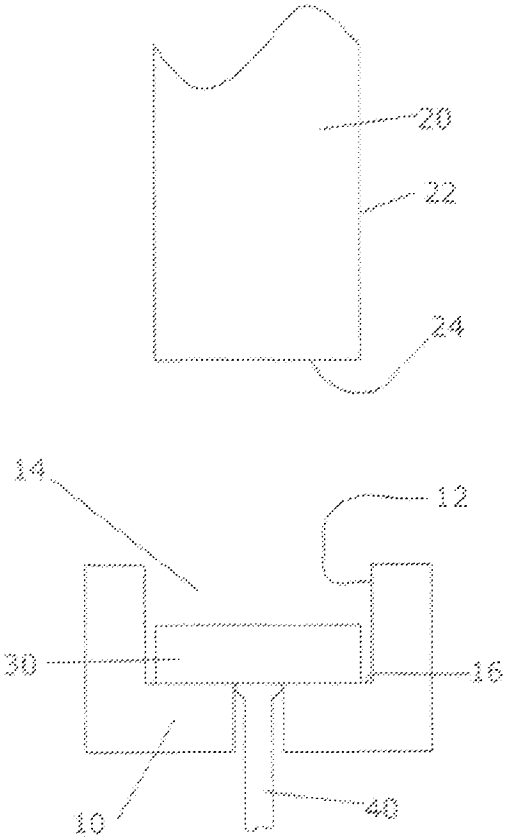
FIG 1A PRIOR ART

As schematically illustrated in FIGS. 1A to 1C, the basic setup of a conventional impact extrusion system includes an extrusion die 10 having an inner wall 12 defining an extrusion cavity 14 of a shape and size required for generation of the exterior of a hollow preform to be extruded, an extrusion punch 20 for insertion into the extrusion cavity 14 and impact with a metal billet 30 received in the extrusion cavity 14, and ejector 40 for ejecting the preform 50, once extruded. The extrusion punch 20 has an axis 23, an axially forward impacting end 21, an axially rearward driven end 25 for attachment to a ram (not shown). In a first process step as illustrated in FIG. 1A, a slug or billet 30 of metal, preferably an aluminum alloy, is placed onto a bottom surface 16 of the die cavity 14, while both the punch 20 and the ejector 40 are in their respective retracted position. The billet 30 may be for example a slug produced by cutting a rod shaped material into slices, or a slug produced by blanking or cutting out a rolled plate material. In the extrusion step as illustrated in FIG. 1B, the punch 20 is forcefully brought to bear on the billet 30, thereby causing the metal of the billet 30 to plasticize and flow by reverse extrusion upwardly around the walls of the punch 20 to fill the die cavity 14 around the punch 20 and form the flowing material into the preform 50 illustrated in FIG. 7. After completion of the downward stroke, punch 20 is then withdrawn upwardly to allow for ejection of the preform 50. In the ejection step illustrated in FIG. 1C, the extruded preform 50 is ejected from the die 10 by advancement of ejector 40. The preform can then be further deformed, for example in a pressure ram forming process as disclosed in U.S. Pat. No. 7,107,804.

Figure 2:
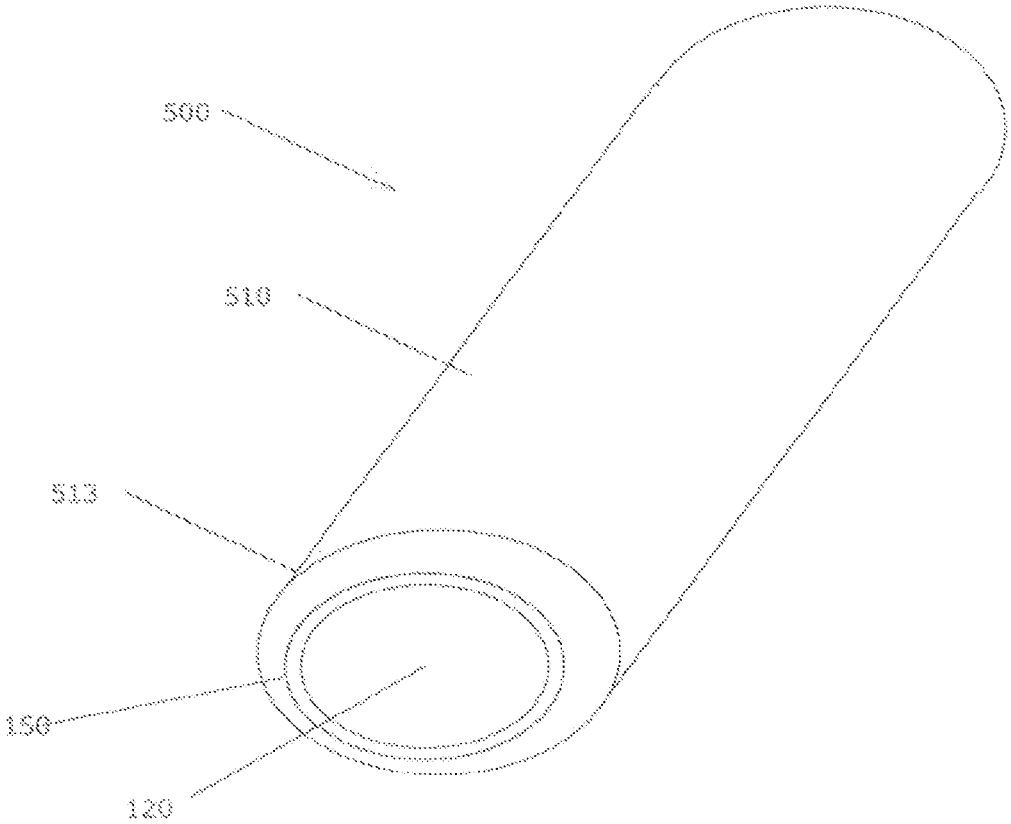
FIG 2 PRIOR ART
FIG. 2 illustrates a conventional metal container.

As illustrated in FIG. 2, a conventional beverage container 500, especially for beverages under pressure due to carbonation, includes a sidewall 510, a bottom end 513 with a domed bottom 520 and a rim 550 on which the container is supported. The domed bottom 520 and the rim 550 can be formed by deep drawing a sheet based material, or by pressure expanding a cylindrical preform, for example in the conventional pressure ram forming process of U.S. Pat. No. 7,107,804. In this conventional pressure ram forming process, the domed bottom 520 and the rim 550 are formed during advancement of the ram (not illustrated). Advancement of the ram leads to inward deformation (doming) of the closed bottom end of the preform and to a rolling-in of a bottom end of the sidewall 510. The pressure ram forming process is well known to the art-skilled person and need not be discussed in any further detail herein.

Expandable Preform

Figure 3A:
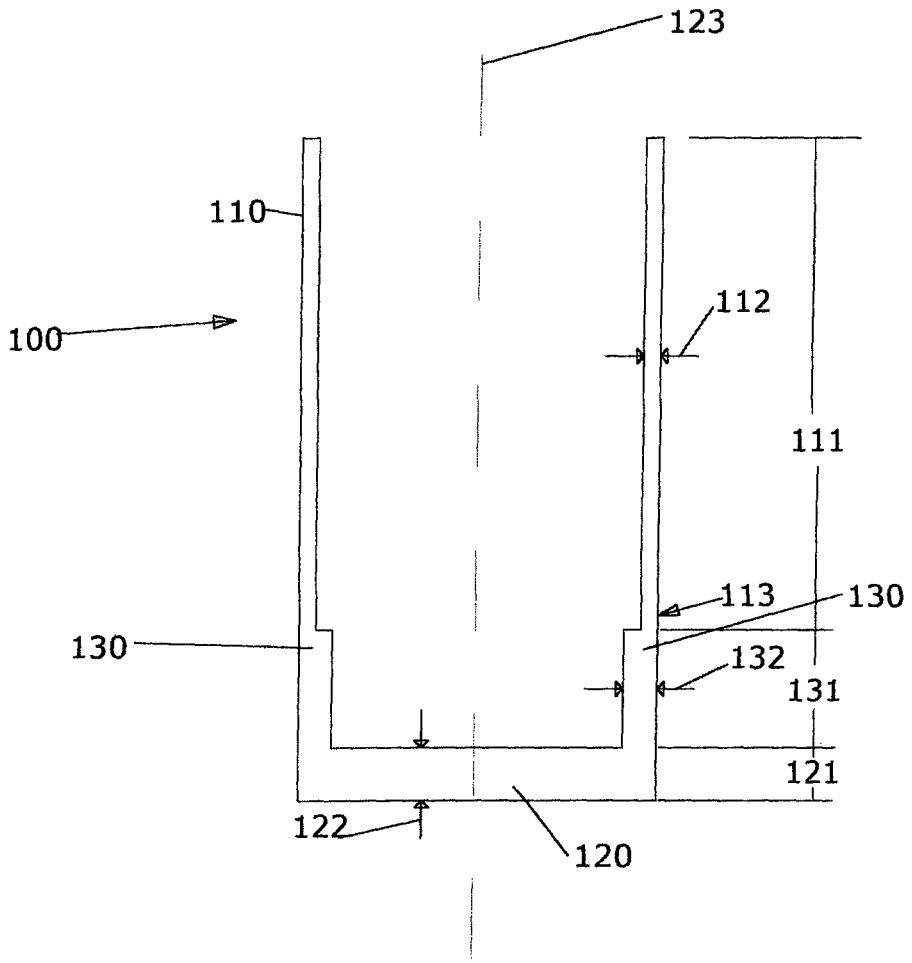
FIG. 3A illustrates an axial cross-section through an exemplary expandable preform in accordance with the invention.
Figure 3B:
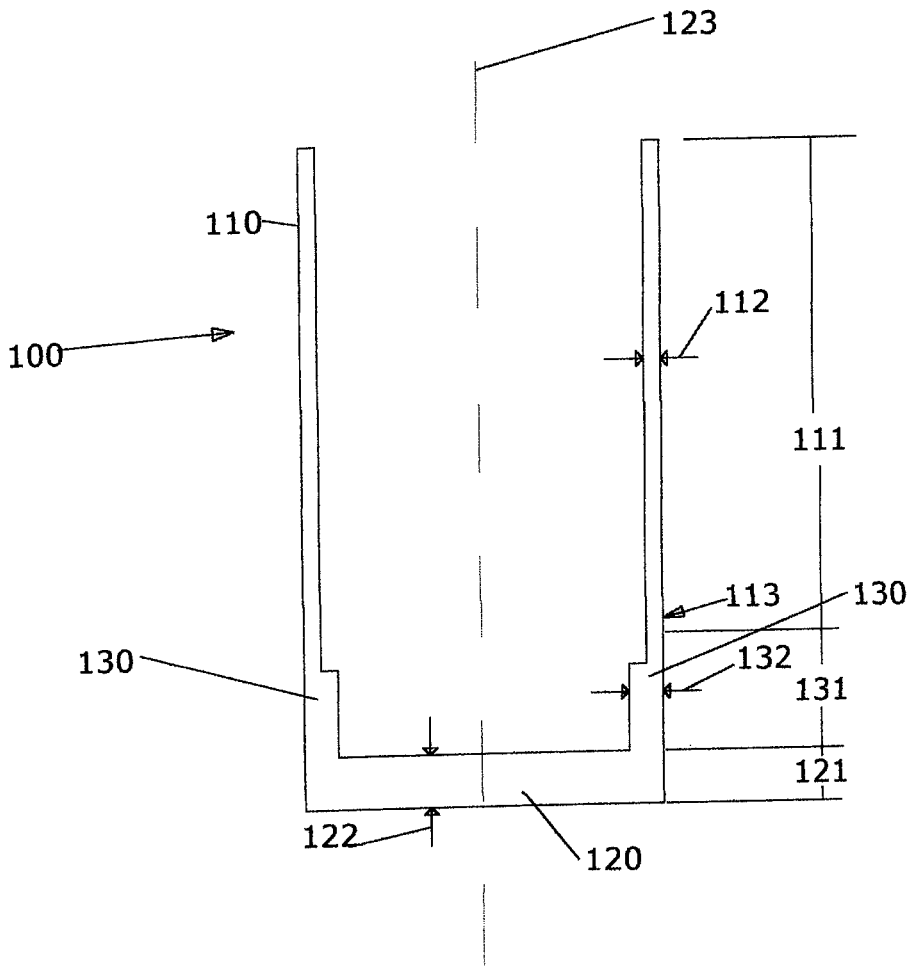
FIG. 3B illustrates an axial cross-section through a variant of the exemplary expandable preform of FIG. 3A.
Figure 4:
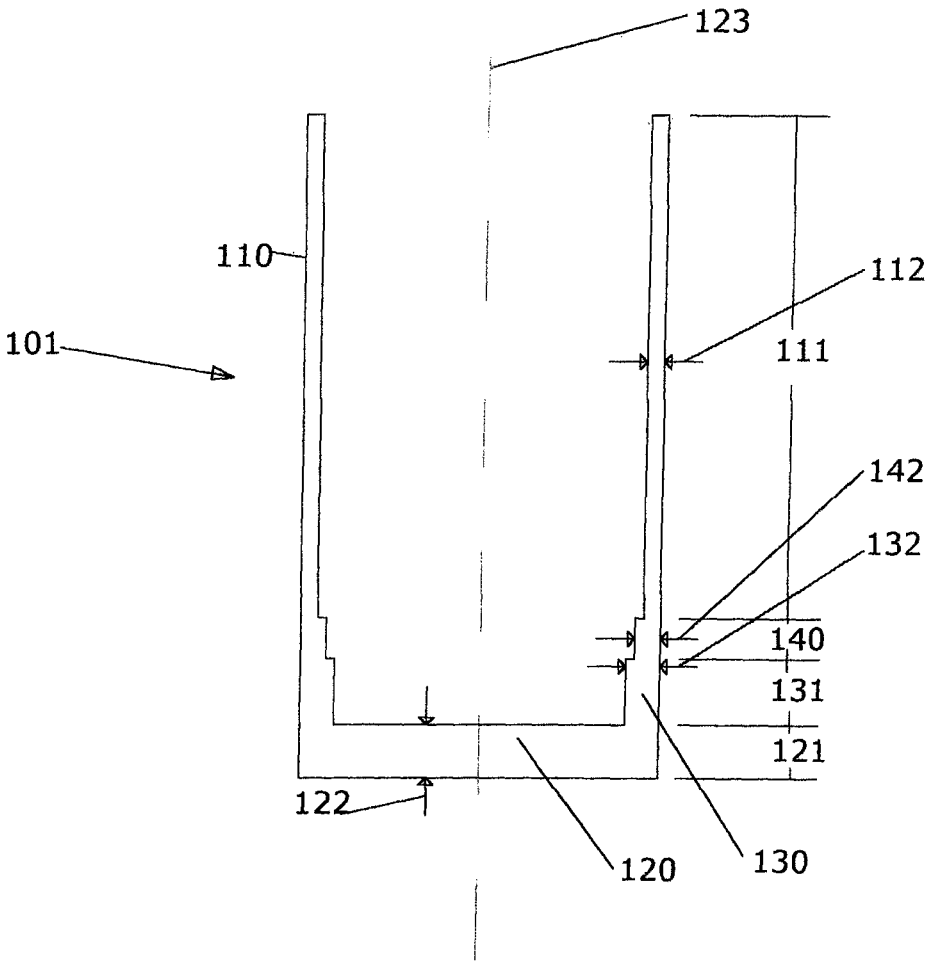
FIG. 4 illustrates an axial cross-section through another exemplary expandable preform in accordance with the invention.
Figure 5:
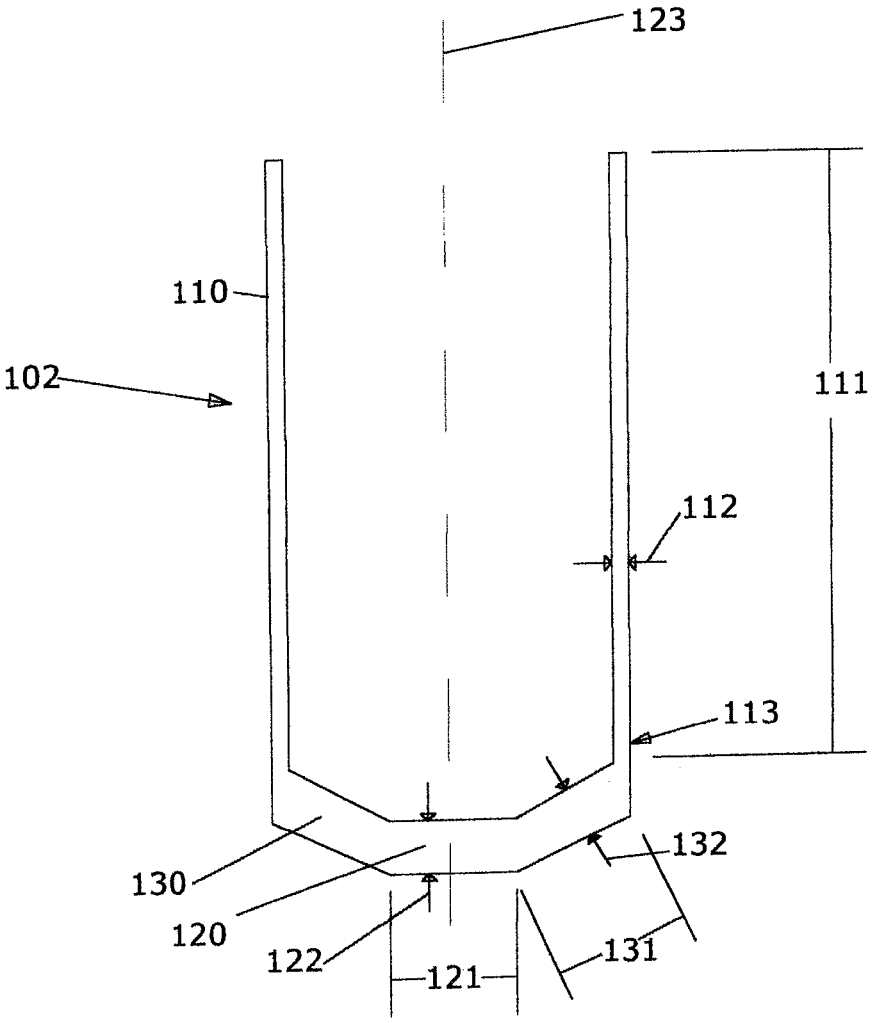
FIG. 5 illustrates an axial cross-section through a further exemplary expandable preform in accordance with the invention.

As illustrated in FIGS. 3 to 5, an exemplary preform 100 in accordance with the instant specification is intended for use for the manufacture of an expansion shaped metal container having a closed bottom, a rim and a sidewall. The preform includes a tubular wall 110, a longitudinal axis 123 and a closed end 120. The tubular wall 110 includes a sidewall forming portion 111 which will form the sidewall in the finished expanded container. The closed end 120 includes a bottom forming portion 121 which will form the bottom of the finished expanded container. The preform 100 further includes a rim forming portion 131 which is rolled-in during pressure ram forming of the expanded container made from the preform (see FIGS. 7A to 10) to form the rim of the container. The rim forming portion 131 includes a transition wall 130 which may extend over the whole rim forming portion 131 as shown in FIG. 3A or over only a majority of the rim forming portion 131 as shown in FIG. 3B, in which latter case the rim forming portion 131 includes both the transition wall 130 adjacent the bottom forming portion 121 and a lower end 113 of the tubular wall 110 (see FIG. 3B). The bottom forming portion 121 has a bottom wall thickness 122, the sidewall forming portion 111 has a sidewall thickness 112 and the transition wall 130 has a transition wall thickness 132. In the exemplary embodiment of FIG. 3A, the sidewall thickness 122 is less than the transition wall thickness 132, which is less than the bottom wall thickness 122. In the illustrated exemplary embodiment, the transition wall 130 is part of the tubular wall 110 and is directly adjacent the closed end 120 of the preform. The transition wall 130 is provided to generate the whole rolled-in rim 150 in the expanded container 180, as will be discussed in more detail below with reference to FIG. 7A.

Figure 7A:
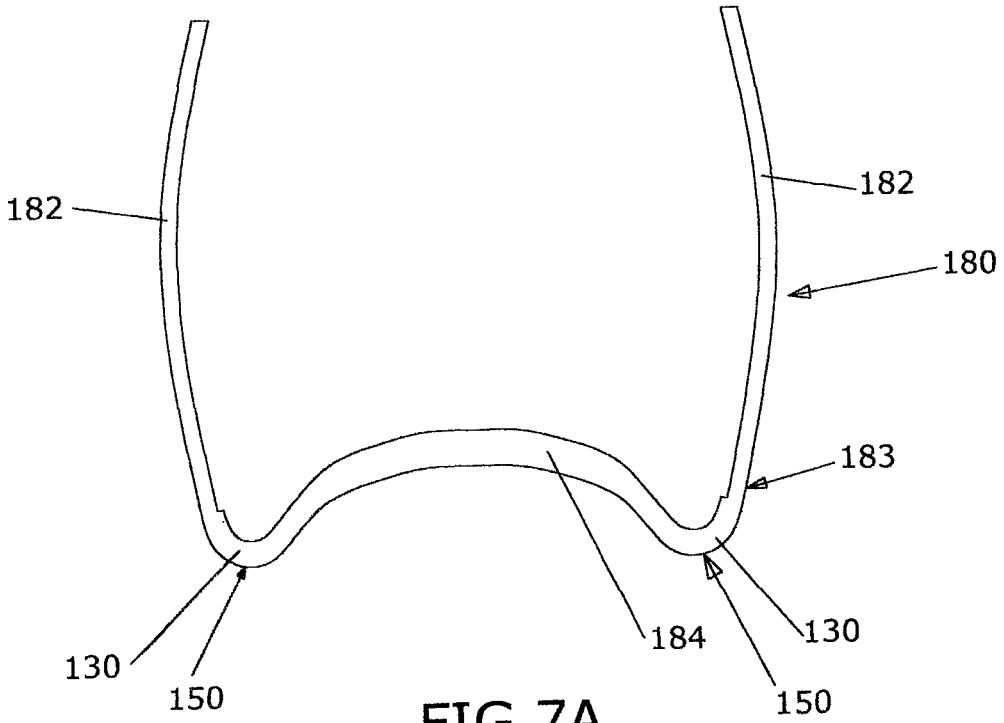
FIG. 7A schematically illustrates an axial cross-section of a container formed from the preform of FIG. 3 using a pressure ram forming process.

With the preform of FIG. 3A, an expanded container 180 as shown in FIG. 7A can be achieved, which has an increased wall thickness at the lower end 113 of the sidewall 182, when the closed end 120 of the preform is deformed during a pressure ram forming process to form the domed bottom end 184 of the container 180. As mentioned above, the transition wall 130 of the rim forming portion 131 at the lower end 113 of the tubular wall 110 is rolled inward in the pressure ram forming process when the bottom end 120 is transformed from a convex shape to a concave shape by the ram, forming a curved rim 150 in the expanded container 180 (FIG. 7A).

By forming the transition wall 130 with a larger wall thickness than the remainder of the tubular wall 110, the rolled-in rim 150 is strengthened compared to containers made from preforms with a tubular wall of constant sidewall thickness. By providing the transition wall 130 in the shape of an annular portion of the preform 100, a pressure ram formed and expansion shaped, expanded container 180 can be produced from the preform 100, which includes a thickened rolled-in rim portion 150 adjacent the concave bottom end 184 and at the lower end 113 of the sidewall 182.

This provides two advantages. First, the thickened rolled-in rim is sufficiently strengthened to reliably withstand the bending stresses imparted during the pressure ram forming process, thereby significantly decreasing the risk of container failure at the rolled-in rim during container filling and pressurization. Second, the thickened rolled-in rim portion has sufficient stiffness, due to the added wall thickness, to avoid unrolling of the rim 150 upon filling and pressurization of the container 180. This is a significant advantage, since it allows use of the container not only for carbonated beverages, but also for aerosol charges.

Figure 7B:
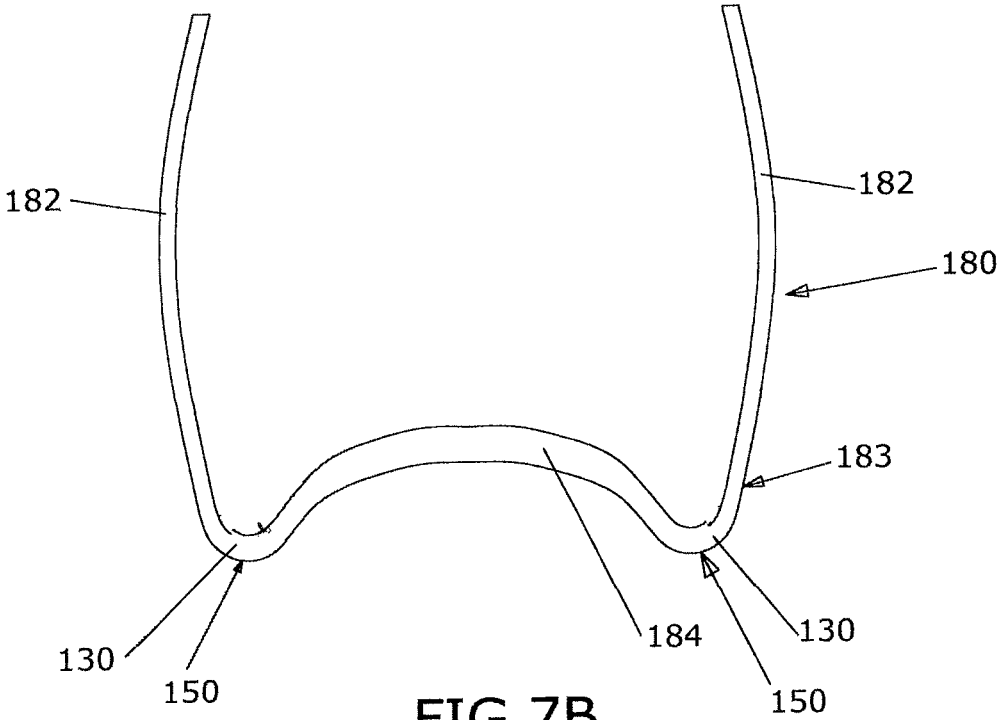
FIG. 7B schematically illustrates a cross-section through a variant of the container of FIG. 7A.

The transition wall 130 is provided in the preform 100 of FIG. 3A to extend over the whole rim forming portion 131 so that it forms the complete rolled in-rim 150 in the expanded container as shown in FIG. 7A. Alternatively, the transition wall 130 extends only over a majority of the rim forming portion 131, as shown in FIG. 3B so that it forms a majority of the rolled-in rim 150, in this embodiment at least the inner portion 151 of the rolled-in rim 150 in the expanded container 180, as shown in FIG. 7B.

During testing of exemplary expandable preforms with a transition wall 130 in accordance with the present specification, the inventors have found that it was not necessary to make the transition wall 130 of a sufficient axial width in the preform 100 to form the whole rim 150 in the finished expanded container 180, contrary to what is illustrated in FIG. 7A. During the testing, the inventors have found that upon pressurization of the finished expanded container beyond its pressure resistance limit, the domed bottom end 184 is forced outward, but initially without deformation of the domed end. Instead, deformation commences in the rim 150, in particular in the inner half 151 of the rim, which extends between the domed bottom end 184 and the lowest point of the rim. The inventors surprisingly discovered that the pressure resistance of the finished expanded container is improved even if the transition wall extends over only a small part of the rim forming portion 131, as long as it extends from the bottom forming portion 121, since such transition wall will lead to a strengthening of the inner half of the rim. The inventors further surprisingly discovered that a finished expanded container with significantly increased pressure resistance can be achieved with a preform wherein the transition wall 130 extends over less than the whole rim forming portion 131, as long as the transition wall 130 is of sufficient axial width in the preform to extend over at least that inner half 151 of the rim 150 in the finished expanded container and that widening the transition wall to extend over the remainder of the rim results in a much lower pressure resistance increase than what is initially achieved with the transition wall extending over the inner half of the rim. Thus, since the rim 150 in the shaped container 180 originates from the rim forming portion 131 in the preform 100, a shaped container with significantly increased pressure resistance can be achieved with a preform wherein the transition wall 130 extends from the bottom forming portion 121 over at least half of the rim, preferably a majority of the rim forming portion 131, as shown in FIG. 3B. Such a preform will then lead to an expanded container 180 in which the rim 150 has the transition wall thickness 132 from the bottom end 184 to at least past the peak of the rim 150 (over the majority of the rim), as shown in FIG. 7B. This means the rolled-in rim 150 has the transition wall thickness 132 over the whole inner half 151 of the rim 150, which is that portion of the rim that is deformed first during roll-out of the rim.

Preforms of different size can be used for the production of pressure expanded containers of various sizes. The term size hereby covers both the diameter of a preform of circular cross-section and the width of a preform of non-circular cross-section. However, a preform of a certain size cannot be used for the manufacture of expanded containers of all desired sizes, due to the expansion limits of the materials used. The relative difference in sizes between the starting preform used and the finished expanded container is therefore relatively narrow as is the range of transition wall widths useful for the creation of the inner half of the rim.

In an exemplary preform of circular cross-section and a 38 mm diameter, the transition wall 130 extends from the closed end 120 to an axial width of about 1 mm to about 15 mm. This equals about 5% to about 80% of the spacing of the transition wall 130 from the axis 123 of the preform. Advantageous pressure resistance was observed with pressure ram formed, expanded containers made from an exemplary 38 mm preform 100 as illustrated in FIG. 3B, wherein the width of the transition wall was about 6 mm to about 10 mm (about 30% to about 53% of spacing from axis). The best pressure resistance was observed with containers made from preforms having a transition wall 130 extending over at least a majority of the rim forming portion 131, in particular over a width of about 7 mm to about 9 mm (about 36% to about 47% of spacing from axis). An expanded container of 46 mm diameter with acceptable pressure resistance was achieved using an exemplary preform of 36 mm diameter, if the axial width of the transition wall 130 was at least about 7 mm (about 36% of spacing from axis). An expanded container of 48 mm diameter with acceptable pressure resistance was achieved using an exemplary preform of 38 mm diameter, if the axial width of the transition wall 130 was at least about 9 mm (about 47% of spacing from axis). As will be readily apparent, larger diameter containers of, for example, 53 mm or 59 mm diameter, or larger, can also be made using larger diameter preforms, as long as the axial width of the transition wall in the respective preform is about 5% to about 80% of the spacing of the transition wall from the axis of the preform, advantageously about 30% to about 53%, or about 36% to about 47%.

The metal billet can be formed of any metal that can be plasticized by impacting and that is suitable for expandable containers. The metal may be made of aluminum, including substantially pure aluminum as well as aluminum alloys of, for example, the 1000, 2000, 3000, 4000, 5000, 6000, 7000 or 8000 Series, for example 1000 Series or 3000 Series Alloys, such as 1070, 1050, 1100 and 3207 Alloys.

For superior results during pressure ram forming, the transition wall thickness 132 is preferably about equal to the bottom wall thickness 122.

The rim forming portion 131 can have a constant thickness in circumferential direction or may have a varying thickness in circumferential direction. The varying thickness can be achieved by providing the rim forming portion with either thicker and thinner panels (not shown) or with ribs (not shown). Such circumferentially varying thickness allows for a reduction in the amount of material used, while still providing the preform with added strength for blow molding and pressure ram forming and providing a rim in the finished expanded container which gives the finished container a pressure resistance comparable to expanded containers made from preforms with circumferentially evenly thick rim forming portions.

Although the exemplary preforms illustrated in FIGS. 3A to 6 are of generally cylindrical shape, the present invention also includes tubular preforms with multilobal cross-section or cross-sections in the form of regular or irregular geometric shapes, such as elliptical, triangular, rectangular, pentagonal, hexagonal, heptagonal, or octagonal. The achievement of preforms of non-cylindrical cross-section will only be limited by the shape and size of the extrusion die and extrusion punch used. However, as will be appreciated by the person of skill in the art, the sidewall features included in the exemplary preforms disclosed above can be readily included in tubular preforms of any geometric shape that can be made by impact extrusion.

In a first variant preform 101, as illustrated in FIG. 4, the tubular wall 110 has multiple steps. The first variant preform 101 includes the sidewall forming portion 111, a closed end 120 and the rim forming portion 131. The rim forming portion 131 includes the transition wall 130 directly adjacent the closed end 120, as well as a thickened sidewall portion 140 located between the transition wall 130 and the sidewall forming portion 111. The closed end 120 has a bottom wall thickness 122, the transition wall 130 has a transition wall thickness 132 and the thickened sidewall portion 140 has an increased sidewall thickness 142. The sidewall forming portion 111 has a sidewall thickness 112 less than the transition wall thickness 132 and less than the increased sidewall thickness 142. In the illustrated embodiment, the transition wall 130 and the thickened sidewall portion 140 are in the shape of annular portions of the overall tubular wall 110. The transition wall 130 is provided to generate at least the inner half 151 of the rolled-in rim 150 with the thickened sidewall portion 140 generating the remainder of the rim 150 (FIG. 8), when the closed end 120 of the preform 101 is deformed during a pressure ram forming process for the shaping of an expanded container. Alternatively, the thickened sidewall portion 140 may extend into the sidewall 182 of the expanded container 180 (not illustrated).

Figure 8:
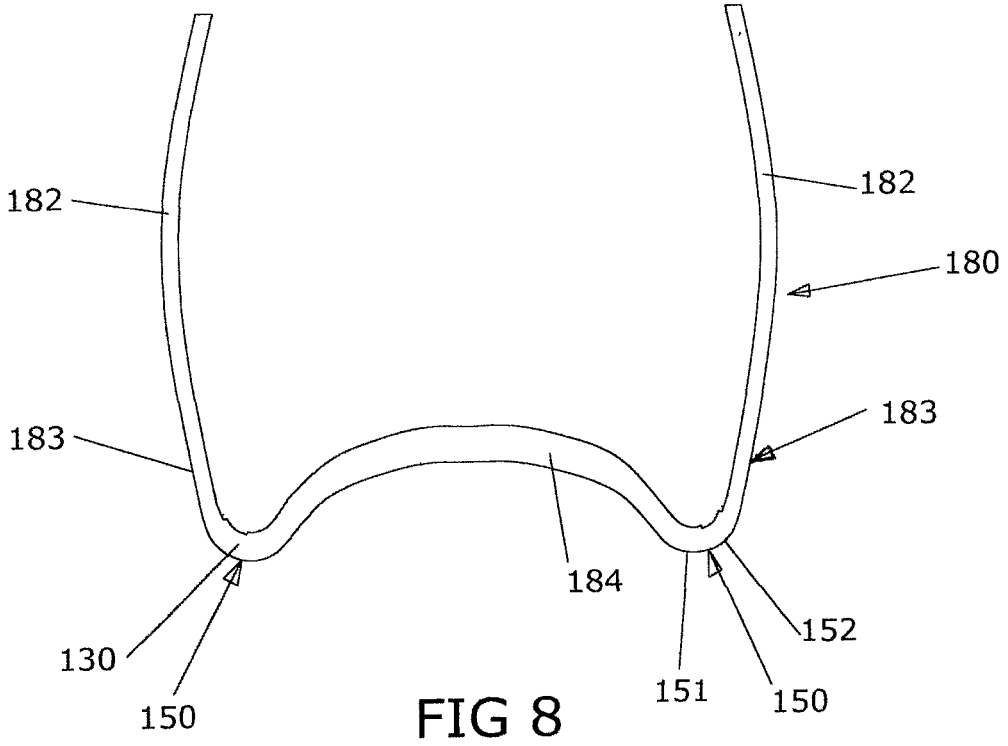
FIG. 8 schematically illustrates an axial cross-section through a container formed from the preform of FIG. 4 using a pressure ram forming process.
Figure 9:
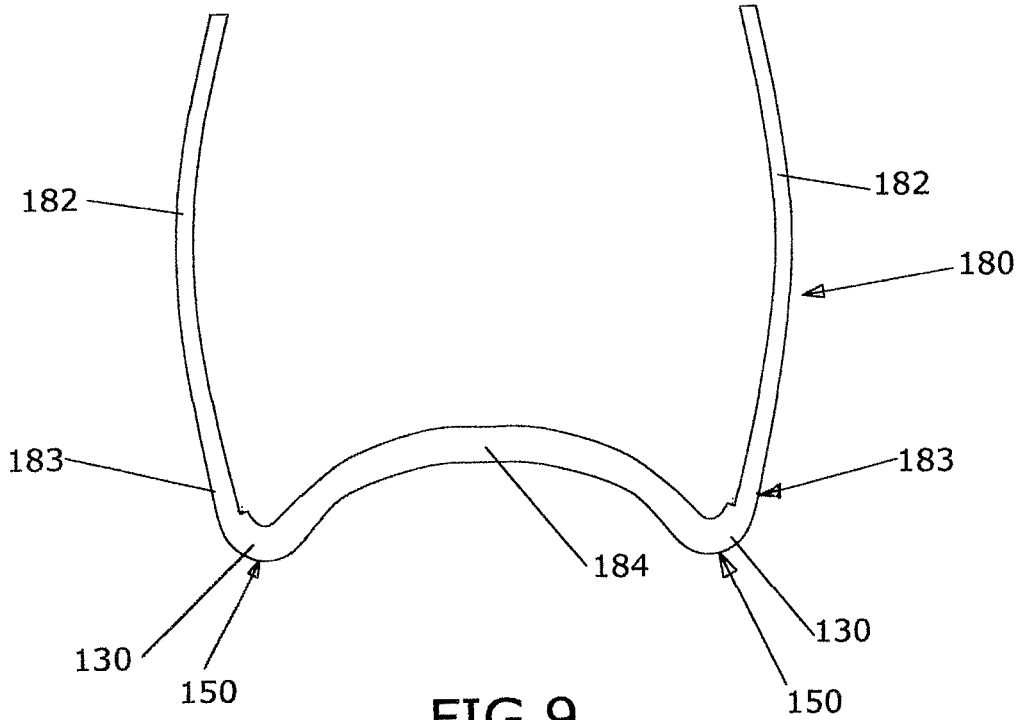
FIG. 9 schematically illustrates an axial cross-section through a container formed from the preform of FIG. 5 using a pressure ram forming process.
Figure 10:
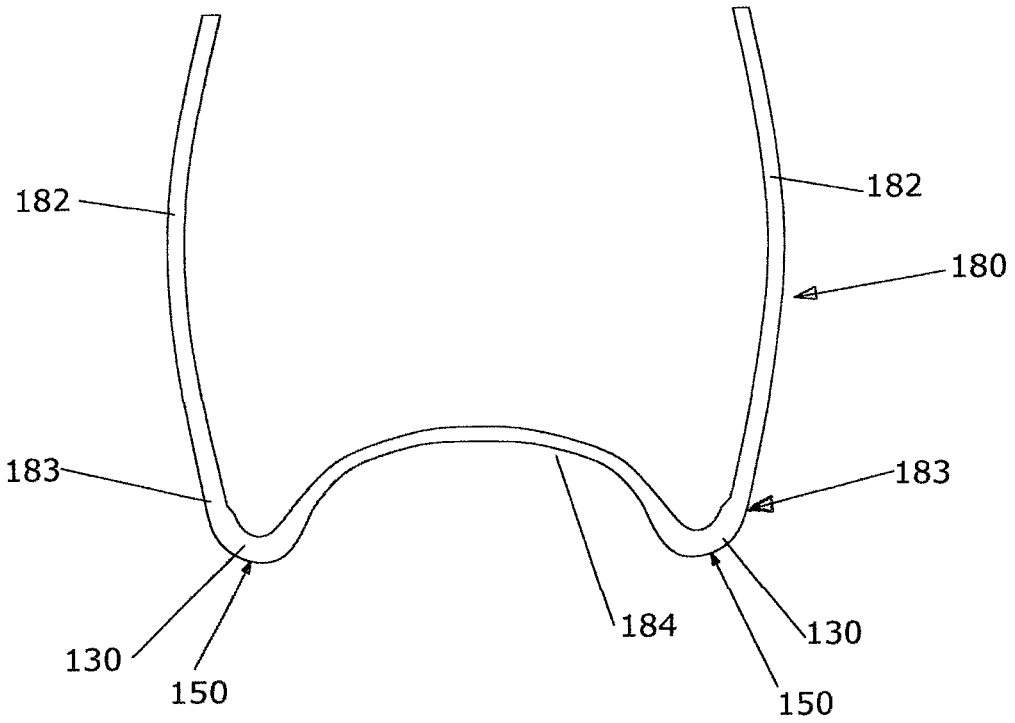
FIG. 10 schematically illustrates an axial cross-section through a container formed from the preform of FIG. 6 using a pressure ram forming process.

When the closed end 120 of the first variant preform 101 is domed and the rim forming portion 131 rolled inward during the pressure ram forming process, the curved rim 150 is formed which occurs in the expanded container 180 (FIG. 8). The transition wall 130 is provided in the first variant preform 101 to form the inner half of the rolled-in rim 150 of the expanded container. By forming the transition wall 130 with a larger wall thickness than the remainder of the sidewall 110, the rolled-in rim 150 is strengthened compared to containers made from preforms with a constant sidewall thickness. By providing the thickened sidewall portion 140 in the first variant preform 101, a pressure ram formed container can be produced from the first variant preform 101, which includes the thickened inner half 151 of the rolled-in rim portion 150 adjacent the concave bottom end 184 and originating from the transition wall 130 and a thickened outer half 152 of the rim 150 originating from the thickened sidewall portion 140 and located between the inner half 151 and the remainder of the sidewall 182. This provides several advantages. First, the thickened rolled-in rim 150 is sufficiently strengthened to reliably withstand the bending stresses imparted during the pressure ram forming, thereby significantly decreasing the risk of container failure at the rolled-in rim during container filling and pressurization. Second, the thickened inner half 151 of the rolled-in rim 150 has sufficient stiffness, due to the added wall thickness, to avoid unrolling of the rim upon filling and pressurization of the container, allowing the container to be used not only for carbonated beverages, but also for aerosol charges. Third, the thickened outer half 152 allows for a stepwise gradual thinning of the rim 150 and the sidewall 182, thereby reducing the puncture rate at the transition between the rim forming portion 131 and the sidewall forming portion 111 during expansion deforming of the preform, for example by blow molding. Fourth, the stepwise gradual thinning of the sidewall 182 of the finished expanded container 180, achieved with the annular transition wall 130 and thickened sidewall portion 140 provides for a more controlled expansion shaping of the first variant preform 101 during a blow molding process, since the stepwise gradual transition of the sidewall thickness leads to a more centered deformation above the closed end 120 during pressure expansion. Fifth, the stepwise gradual decrease in the gradual thinning of the sidewall 110 from the closed end 120 increases the pressure holding capacity of the expanded container 180 shaped from the first variant preform 101. The section of the first variant preform 101 including the first and second annular portions of transition wall 130 and thickened sidewall portion 140 opens like an umbrella during expansion by blow molding, thereby maintaining the closed end 120 generally perpendicular to the preform's main axis.

The thickened sidewall forming portion 140 may extend from the transition wall 130 to an axial width of about 1 mm to about 5 mm (about 3% to about 15% of preform diameter).

Advantageous pressure resistance was observed when testing pressure ram formed containers made from this exemplary first variant preform 101, in particular when the preform diameter was 36-38 mm, the axial width of the transition wall 130 was about 6 mm to about 10 mm and the axial width of the thickened sidewall forming portion 140 was about 2 mm to about 4 mm (about 6% to about 12%). The best pressure resistance was observed with containers made from preforms of 38 mm, having a transition wall with an axial width of about 9 mm and a thickened sidewall forming portion 140 with an axial width of about 3 mm (about 9%). Pressure resistance is most effectively controlled by way of the transition wall thickness 132. Improved pressure resistance in finished expanded containers was achieved with preforms wherein the transition wall thickness 132 was equal to the bottom wall thickness 122.

Figure 21:
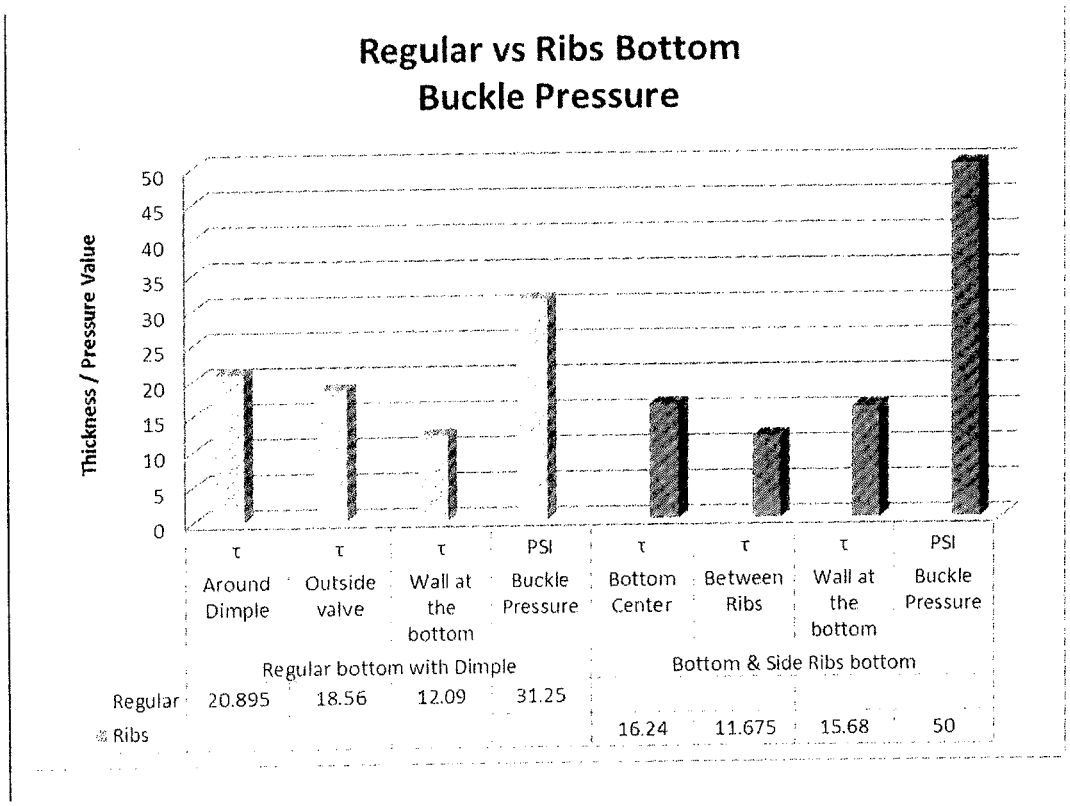
FIG. 21 is a graph comparing pressure resistance performance of expanded containers made from preforms with and without a ribbed rim forming portion.

Moreover, for good results during pressure ram forming, the increased sidewall thickness 142 is preferably twice the sidewall thickness 112. Further annular portions in the sidewall 110 may be added (not illustrated) to either stepwise gradually vary the thickness of the preform produced, or to increase and decrease the sidewall thickness along the main axis of the preform, both of which may be advantageous for blow molding of shapes with aggressive shape changes. Each annular portion may have a varying thickness in circumferential direction to provide either thicker and thinner panels (not shown) or ribs (not shown) in the annular portion, or the bottom forming portion 121 and the rim forming portion 131, which allows for added strength for blow molding and pressure ram forming and for added pressure resistance in the filled container product. Table 1 below illustrates the increased pressure resistance of a finished shaped container formed from a preform with a ribbed rim forming portion, compared to a container made from a preform devoid of ribs. The pressure testing data of Table 1 are summarized in the graph of FIG. 21. As is apparent, providing the rim forming portion and/or the bottom forming portion with ribs provides the resulting expanded container with a higher buckling pressure and, thus, higher pressure capacity. In Table 1, the term dimple refers to a centering recess as will be discussed further below with reference to FIG. 11, and the term valve refers to the axial tappet valve discussed below in relation to FIG. 16.

TABLE 1

| | Regular bottom | | | | | | | | | |
|---|---|---|---|---|---|---|---|---|---|---|
| | Around Dimple | | | Outside valve | | | Wall at the bottom | | | Buckle Pressure |
| | Min | Max | AVG | Min | Max | AVG | Min | Max | AVG | PSI |
| 1 | 21 | 26.5 | 23.8 | 18.1 | 25 | 21.55 | 10.2 | 11.8 | 11 | 35 |
| 2 | 18.6 | 22 | 20.3 | 14.7 | 20 | 17.35 | 11.8 | 13 | 12.4 | 32 |
| 3 | 18.7 | 22.3 | 20.5 | 16.8 | 20.3 | 18.55 | 8.9 | 14.5 | 11.7 | Burst |
| 4 | 20.7 | 21.7 | 21.2 | 17.3 | 20 | 18.65 | 11.1 | 14.2 | 12.65 | 29 |
| 5 | 21.3 | 24 | 22.7 | 16.9 | 22.4 | 19.65 | 10.2 | 15.2 | 12.7 | 30 |
| 6 | 17.9 | 20.6 | 19.3 | 14.5 | 18 | 16.25 | 9.7 | 13.8 | 11.75 | 34 |
| 7 | 20.2 | 25.1 | 22.7 | 18.3 | 24.5 | 21.4 | 10.7 | 15 | 12.85 | Burst |
| 8 | 18.6 | 21 | 19.8 | 16.1 | 19.1 | 17.6 | 10.3 | 14.4 | 12.35 | 27 |
| 9 | 20.7 | 23.8 | 22.3 | 17.1 | 21.4 | 19.25 | 10.2 | 15 | 12.6 | 34 |
| 10 | 15.2 | 18 | 16.6 | 13.4 | 17.3 | 15.35 | 9.4 | 12.4 | 10.9 | 29 |
| Average | | | 20.9 | | | 18.56 | | | 12.09 | 31.25 |

| | Bottom & Side Ribs bottom | | | | | | | |
|---|---|---|---|---|---|---|---|---|
| | Bottom | Between Ribs | | | Wall at the bottom | | | Buckle Pressure |
| # | $Center_T$ | Min | Max | AVG | Min | Max | AVG | PSI |
| 1 | 12.7 | 7.8 | 10 | 8.9 | 12.8 | 16.3 | 14.55 | 43 |
| 2 | 15.9 | 8.9 | 12.8 | 10.85 | 14.2 | 16.4 | 15.3 | blow |
| 3 | 15.9 | 10.5 | 13 | 11.75 | 14 | 16.1 | 15.05 | 52 |
| 4 | 16.7 | 10 | 14.3 | 12.15 | 14.7 | 16.4 | 15.55 | 53 |
| 5 | 15.2 | 9.3 | 12.5 | 10.9 | 14.7 | 15.9 | 15.3 | 50 |
| 6 | 16.4 | 10.2 | 14.6 | 12.4 | 15.4 | 17.9 | 16.65 | 53 |
| 7 | 16.1 | 9.5 | 13.9 | 11.7 | 14.6 | 17.1 | 15.85 | 48 |
| 8 | 21.4 | 11.9 | 17.5 | 14.7 | 15 | 17.9 | 16.45 | 55 |
| 9 | 16.1 | 9.8 | 13.5 | 11.65 | 14.4 | 17 | 15.7 | 51 |
| 10 | 16 | 9.2 | 14.3 | 11.75 | 14.8 | 18 | 16.4 | 45 |
| Avg | 16.2 | — | — | 11.675 | — | — | 15.68 | 50 |

In a second variant preform 102 as illustrated in FIG. 5, the bottom forming portion 121 and the transition wall 130 are both part of the closed end 120 and the sidewall forming portion 111 extends over the whole length of the tubular wall 110. The closed end 120 has a bottom wall thickness 122, the transition wall 130 has a transition wall thickness 132 and the sidewall forming portion 111 has a sidewall thickness 112. The sidewall forming portion 111 has a sidewall thickness 112 less than the transition wall thickness 132. In the illustrated embodiment, the transition wall 130 is in the shape of an annular portion surrounding the bottom forming portion 121. The transition wall 130 is provided to generate a rolled-in rim 150 with increased thickness at the lower end 183 of the sidewall portion 182 in the expanded container 180 (FIG. 9), when the closed end 120 of the preform is deformed during a pressure ram forming process.

When the closed end 120 is domed and the rim forming portion 131 rolled inward during the pressure ram forming process, the curved rim 150 is formed in the expanded container 180 (FIG. 9), which supports the container upright. The transition wall 130 is provided in the second variant preform 102 to form the rolled-in rim 150 in the expanded container. By providing the transition wall 130 with a larger wall thickness than the sidewall forming portion 111, the rolled-in rim 150 is strengthened compared to containers made from preforms with a constant wall thickness. The bottom forming portion 121 and the transition wall 130 are generally of the same thickness in the embodiment of FIG. 5. However, the transition wall 130 is oriented at an angle to the central axis, giving the closed end of the preform a generally frusto-conical shape. Of course, an evenly convexly domed closed end (not shown) can also be used, wherein the transition wall is an annular portion located at the widest part of the domed end and the bottom forming portion is provided by the remainder of the domed end. In both of the frusto-conical closed end and domed closed end variants, the transition wall 130 is oriented at an angle to the central axis to ensure that, during pressure ram forming of the preform, it is the transition wall 130 which is rolled, not the lower end 113 of the sidewall forming portion 111. With this arrangement of the bottom forming portion 121 and the transition wall 130, a pressure ram formed container can be produced from the second variant preform 102, which container includes the thickened rolled-in rim portion 150 intermediate the concave bottom end 184 and the lower end 183 of the sidewall 182. Thus, despite the significantly different shape and portioning of the preform of FIG. 5 as compared to FIGS. 3 and 4, a finished expansion shaped container is produced which is of very similar construction and provides the same advantages as those discussed above in relation to FIGS. 7A, 7B and 8.

Figure 6:
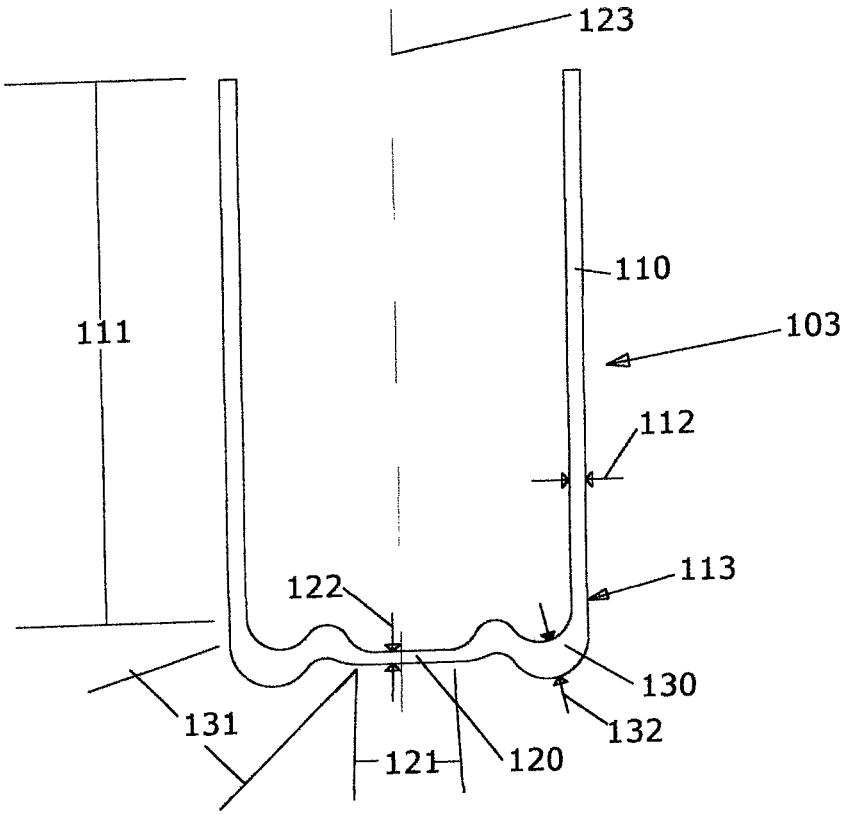
FIG. 6 illustrates an axial cross-section through yet another exemplary expandable preform in accordance with the invention.

In a third variant preform 103 as illustrated in FIG. 6, the bottom forming portion 121 and the transition wall 130 are both part of the closed end 120, but the closed end is neither conical nor domed. As in the second variant of FIG. 5, the sidewall forming portion 111 extends over the whole length of the tubular wall 110. The closed end 120 has a bottom wall thickness 122, the rim forming portion 131 includes transition wall 130 with a transition wall thickness 132 and the sidewall forming portion 111 has a sidewall thickness 112. The sidewall forming portion 111 has a sidewall thickness 112 less than the transition wall thickness 132. In the illustrated embodiment, the transition wall 130 is in the shape of an undulated annular portion surrounding the bottom forming portion 121. The transition wall 130 is provided to generate a rolled-in rim 150 with increased thickness at the lower end 183 of the sidewall portion 182 in the expanded container 180 (FIG. 10), when the closed end 120 of the preform is deformed during a pressure ram forming process. The transition wall 130 has a transition wall thickness 132 larger than the bottom wall thickness 122 and larger than the sidewall thickness 112.

When the closed end 120 of the third variant preform 103 is domed inward and the rim forming portion 131 rolled inward during the pressure ram forming process, the curved rim 150 is formed in the expanded container 180 (FIG. 10), which supports the container upright. The rim forming portion 131 with transition wall 130 is provided in the preform 100 to form the rolled-in rim 150 in the expanded container. By providing the transition wall 130 with a larger wall thickness than the sidewall forming portion 111, the rolled-in rim 150 is strengthened compared to containers made from preforms with a constant wall thickness. The transition wall 130 in the third variant preform 103 is undulated to allow for expansion of the annular transition wall 130 and to ensure that, during pressure ram forming of the preform, it is the transition wall 130 which is rolled, not the lower end 113 of the sidewall forming portion 111. With this arrangement of the bottom forming portion 121 and the transition wall 130, a pressure ram formed container can be produced from the third variant preform 103, which includes the thickened rolled-in rim portion 150 intermediate the concave bottom end 184 and the lower end 183 of the sidewall 182. Thus, despite the significantly different shape and portioning of the third variant preform 103 of FIG. 6 as compared to the preforms of FIGS. 3 to 5, a finished expansion shaped container 180 is produced (FIG. 10), which is of very similar construction and provides at least some of the same principal advantages as those discussed above in relation to the containers of FIGS. 7A to 9.

Although the rim forming portion 131 including the transition wall 130 has been illustrated in FIGS. 3 to 6 as being part of either the tubular wall 110 or the closed end 120, the rim forming portion 131 with transition wall 130 can also be part of both the tubular wall 110 and the closed end 120 (not illustrated), as long as the transition wall thickness is always larger than the sidewall thickness.

Figure 11:
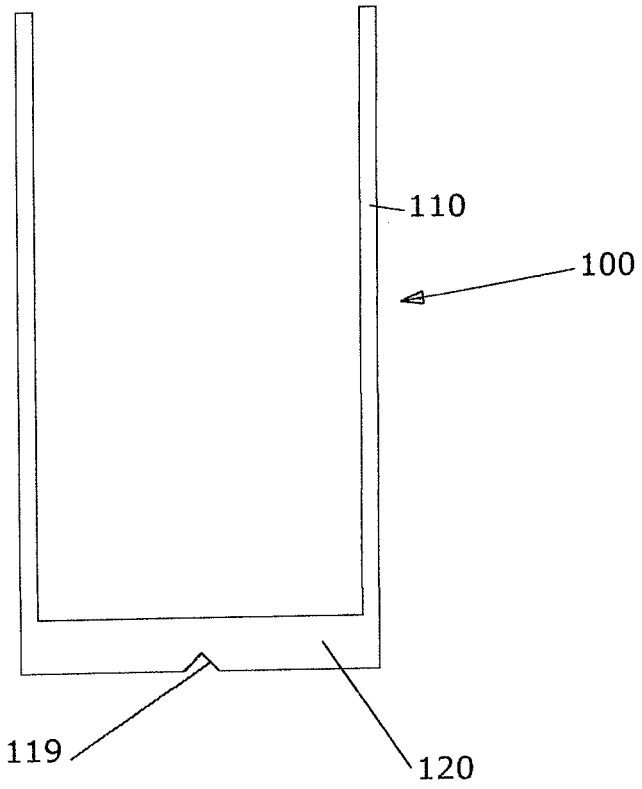
FIG. 11 is an axial cross-section through an expandable preform having a centering structure incorporated into an outside surface of the closed end.
Figure 12:
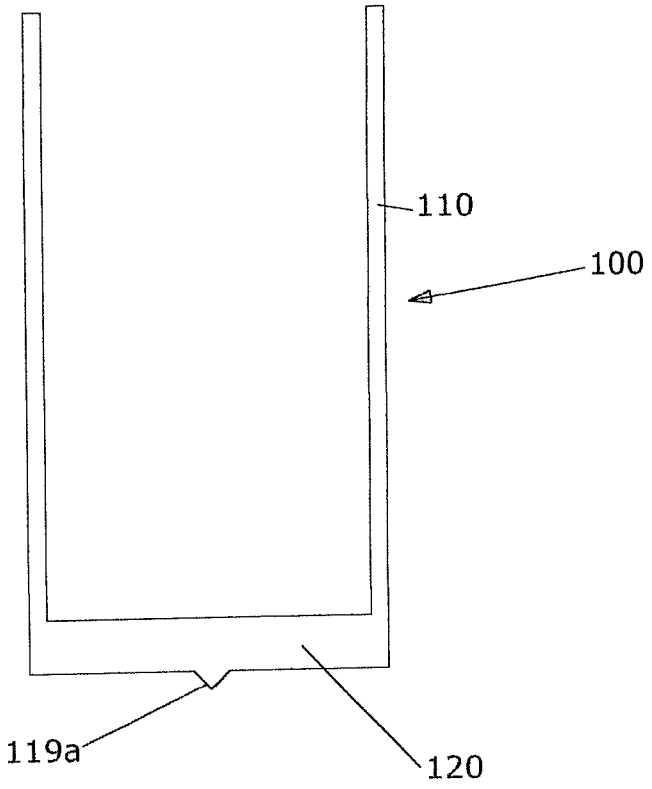
FIG. 12 is an axial cross-section through an expandable preform according to FIG. 11, having a variant centering structure.
Figure 13:
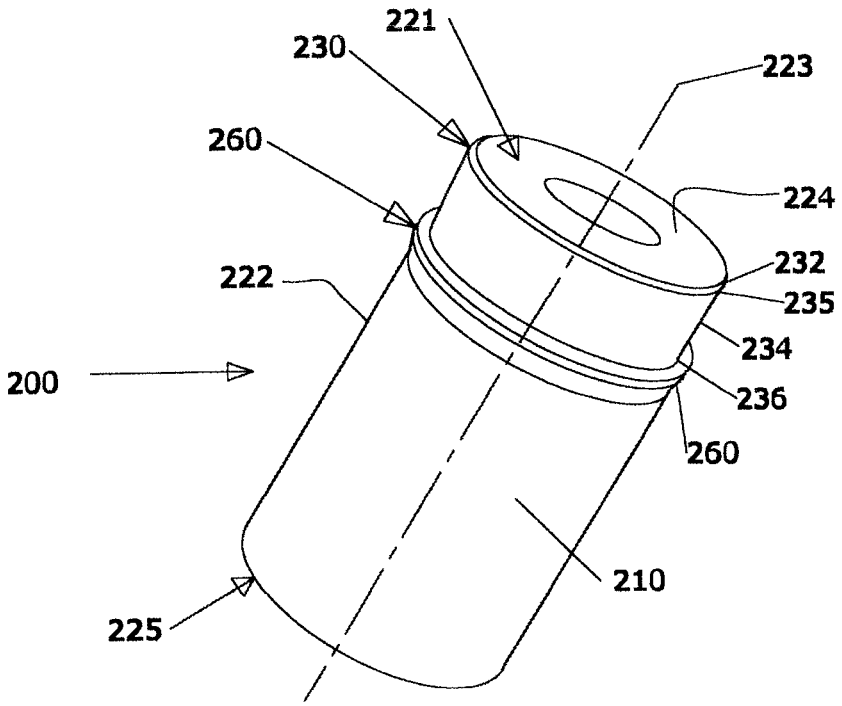
FIG. 13 is a front elevational perspective view of an impact extrusion punch in accordance with the invention and useful for impact extrusion of a preform as shown in FIG. 3.
Figure 14:
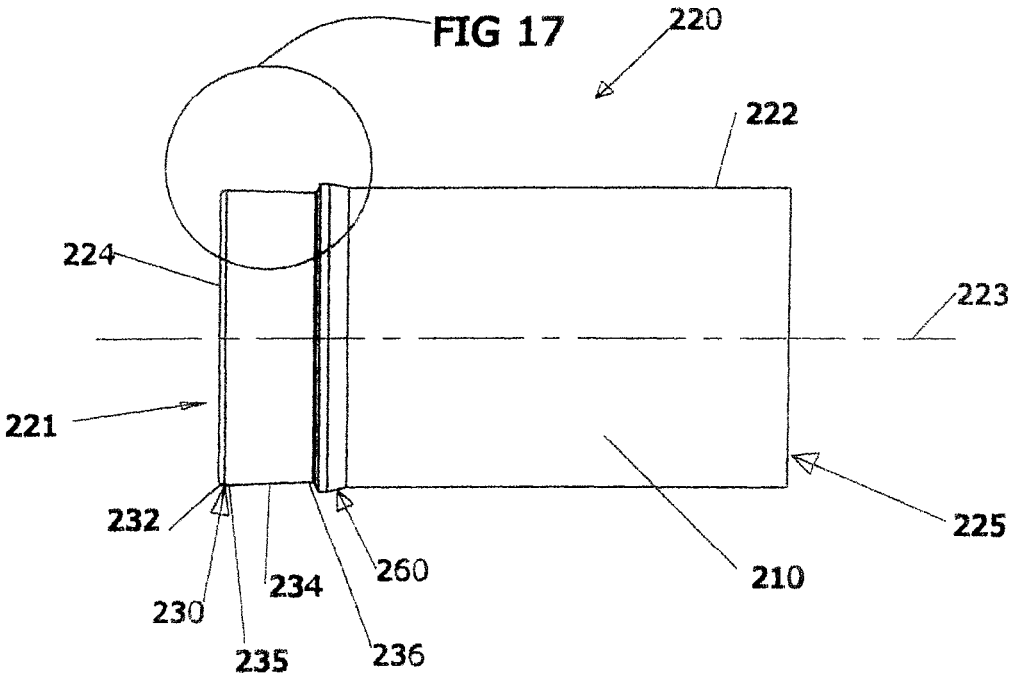
FIG. 14 is a side plan view of the extrusion punch of FIG. 13.
Figure 15:
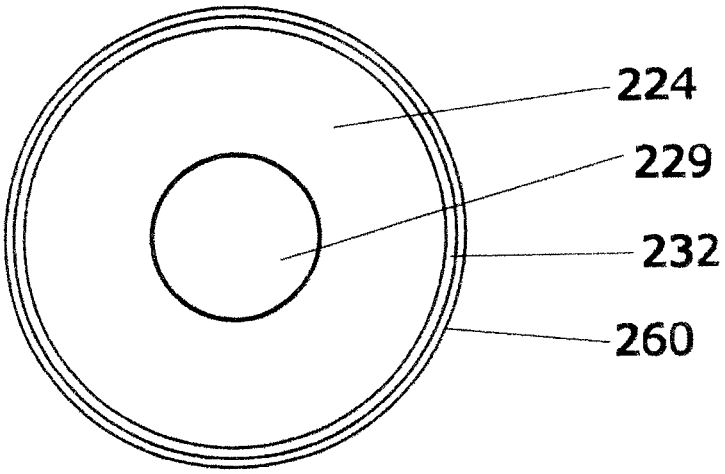
FIG. 15 is a front plan view of the extrusion punch of FIG. 13.

In another aspect, the invention provides that the closed end 120 of the basic preform 100 includes a centering structure, such as a dimple 119, which is used for centering of the preform. Especially during blow molding of the preform and upon onset of the deformation of the sidewall forming portion 111, uneven and un-centered expansion of the preform can sometimes occur, due to slight variations in the thickness of the preform, both radially and axially. Thus, the resulting expansion shaped container would become asymmetrical with the bottom end 120 and the rim 150 being off the central axis. Most often such resulting container is not standing fully vertically when supported on the rim 150. This is a significant manufacturing challenge and can lead to a high rate of waste, unless the closed end 120 of the preform is held centered during the pressure expansion and ram advancing steps. This is achieved in a preform in accordance with the invention and as illustrated in FIGS. 11 and 12 with the centering structure 119, 119*a*, which is intended to be engaged by a complementary structure centered on the ram of the pressure ram forming apparatus in which the preform is to be molded. The centering structure can have any desired shape and can be recessed in or protruding from the closed end 120. In one embodiment as illustrated in FIG. 11, the centering structure is a dimple 119, in another embodiment as illustrated in FIG. 12, the centering structure is a conical point 119*a*.

To achieve a preform 100 with a stepped sidewall 110 as illustrated in FIGS. 3A and 3B, an exemplary impact tooling setup is used in accordance with this application, which preferably includes an extrusion punch with an impact surface for impacting metal to be extruded; a transition region rearward from the impacting surface for directing material displaced by the impact surface; and a rear extrusion point for ironing material directed past the transition region to produce the sidewall forming portion of reduced wall thickness.

In the first variant preform 101, the sidewall has multiple steps (see FIG. 4), which are produced with a variant impact extrusion punch which includes the transition region and rear extrusion point of the basic extrusion punch of the invention and one or more additional extrusion points for generating one or more steps in the preform sidewall.

Impact Extrusion Tooling

An exemplary embodiment of an impact extrusion punch 200 in accordance with the present application will now be discussed in more detail with reference to FIGS. 13 to 20. Extrusion punch 200 includes a body 210 with a central axis 223, an axially forward, impacting end 221 and an axially rearward, driven end 225 for attachment to a driving piston or connecting rod (not shown) of an impact extrusion press (not shown). The impacting end 221 includes impact surface 224 for impacting the metal slug 30 to be extruded (see FIGS. 1A to 1C). The body 210 further includes a transition region 230 and a rear extrusion point 260 axially rearward from the transition region 230. In the illustrated exemplary embodiment, the transition region 230 is formed by a rounded peripheral shoulder 232 of the impact surface 224 and a land portion 234 extending rearward from a forward end 235 at the peripheral shoulder 232 to a rearward end 236. The rear extrusion point 260 is provided for ironing the material redirected by the transition region 230. The rear extrusion point 260 is adjacent the rearward end 236 of the land portion 234. The transition region 230 of the punch 200 is provided for redirecting the material of the metal slug or billet 30 (see FIGS. 1A to 1C) plasticized by the energy introduced upon impact by the punch 200. The plasticizing energy is introduced by the impact surface 224 of the punch 200. The impact energy imparted by the impact surface 224 plasticizes the material and causes the material of the slug to flow. The impact surface 224 displaces the platicized material, generally radially outward, while the transition region 230 of the punch redirects the flowing material rearward. At the forward end 235, the land portion 234 may be positioned further from the central axis 223 than at the rearward end 236. The body 210 may have a circular, multi-lobal, or polygonal cross-section. When the body 210 has a circular cross-section, the land portion 234 may have a frusto-conical shape with an axially rearwardly decreasing diameter.

The land portion 234 preferably has a width in axial direction of about 1 mm to about 15 mm. Generally, the axial width of the land portion 234 is about 5% to about 80% of the spacing of the land portion 234 from the axis 223, at the forward end 221. This axial width is selected according to the axial width of the transition wall portion 130 of the preform 100 to be produced (see FIG. 7). Therefore, the land portion 234 preferably has a width of about 6 mm to about 10 mm (30% to about 53% of spacing from axis), in particular a width of about 7 mm to about 9 mm (about 36% to about 47% of spacing from axis). In a punch for a 36 mm preform, the width of the land portion 234 may be at least about 7 mm (about 36% of spacing from axis), while in a punch for a 38 mm preform, the width of the land portion 234 may be at least about 9 mm (about 47% of spacing from axis).

Figure 17:
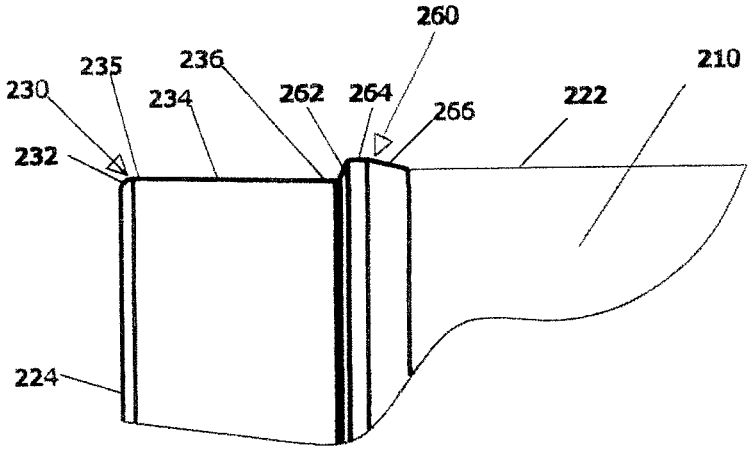
FIG. 17 is a detail cross-sectional view of the first and rear extrusion points of the extrusion punch shown in FIG. 16.

As shown in more detail in FIG. 17, the rear extrusion point 260 includes an axially forward extrusion shoulder 262 for ironing the material displaced past the transition region, by outwardly extruding the material of the initial sidewall extruded past the transitional surface or the forward extrusion point. The extrusion shoulder 262 is followed by a second land portion 264 and a restriction 266 for facilitating removal of the punch from the preform. For advantageous results, the extrusion shoulder is preferably oriented at a blunt angle to the central axis 223, preferably at an angle of about 10 degrees to about 40 degrees, which means it would enclose an angle of about 10 degrees to about 40 degrees with the axis 223, if the extrusion shoulder were extended all the way to the axis.

Figure 16:
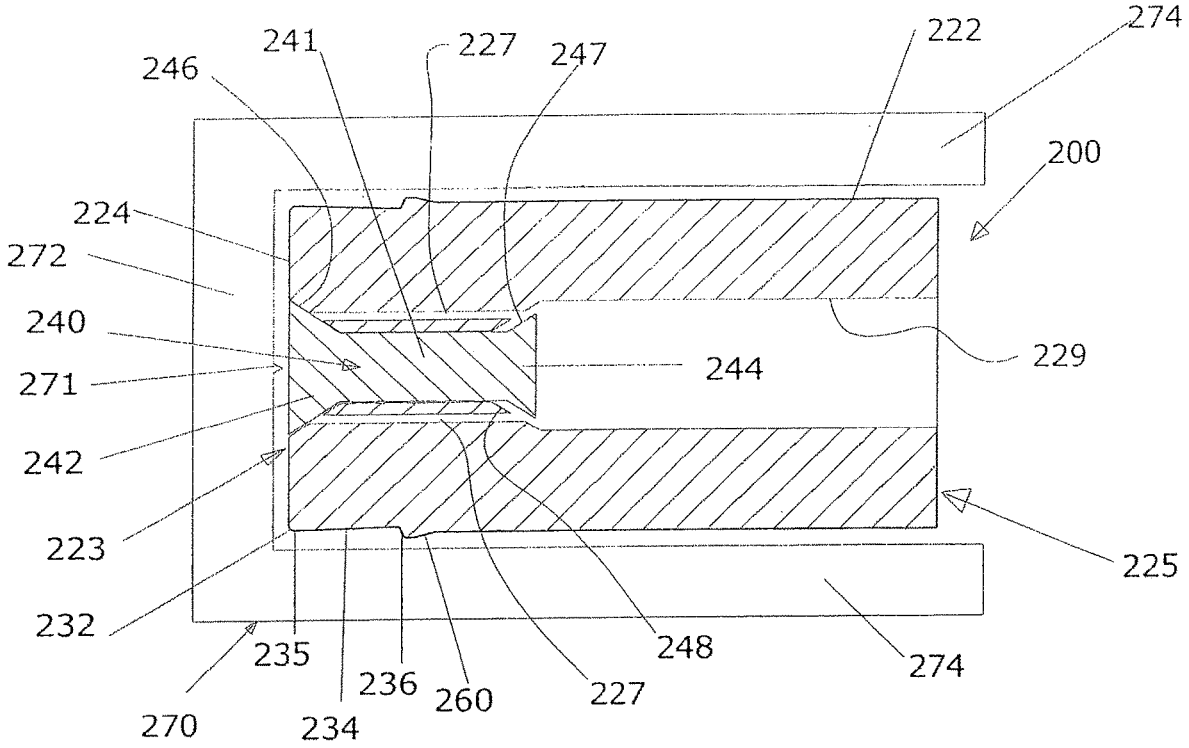
FIG. 16 illustrates an axial cross-section through the extrusion punch of FIG. 13.

Turning now to FIG. 16, the basic extrusion punch 200 in accordance with the present specification may further include a central bore 229 and an axial tappet valve 240 for facilitating removal of the punch from the preform. At the end of the extrusion phase, when forward movement of the punch 200 is completed, removal of the punch from the preform by retraction of the punch (see FIG. 1C) is facilitated by allowing air to enter between the punch 200 and the bottom 120 of the preform. This is achieved by way of tappet valve 240, which is held closed by the impacting pressure during extrusion and automatically opens upon reversing of the punch movement, due both to inertia and to the vacuum created between the impact surface 224 and the bottom 120 of the preform 100. The tappet valve 240 includes a shaft 241, a forward conical end 242 sealingly seatable in a complementary forward valve seat 246 in the punch 200, and a rearward conical end 244 for limiting a forward movement of the valve 240. The length of the shaft 241 is selected to allow the tappet valve 240 to move freely between a sealing position, wherein the forward conical end 242 is pressed into the forward valve seat 246 and a venting position, wherein the forward end 242 is disengaged from the forward valve seat 246 and the rearward conical end 244 rests against a stop shoulder 248 of the central bore 229. Axially oriented vent channels 227 are provided in the punch 200, which open into the forward valve seat 246 and connect the forward valve seat with the central bore 229. In the sealing position of the tapped valve 240, the forward conical end 242 seals the vent channels 227, while in the venting position air is allowed to flow past the rearward conical end 244, through the vent channels 227 and past the forward conical end 242 to prevent the creation of a vacuum between the impacting surface 224 and the bottom 120 of the preform upon retraction of the punch 200.

The punch 200 may be used in combination with a die 270 having a bottom end 272 and sidewalls 274. The bottom end 272 preferably includes a protruding point 271 for generating a centering dimple 119 in the bottom end 120 of the preform 100 produced (see FIG. 11), for use in maintaining the preform axially aligned in the mold during blow molding of the preform as discussed above. Alternatively, the die 270 may include a recess 273 (not shown) in the bottom end 272, for generating a centering point 119*a* in the bottom end 120 of the preform 100 (see FIG. 12).

Figure 18:
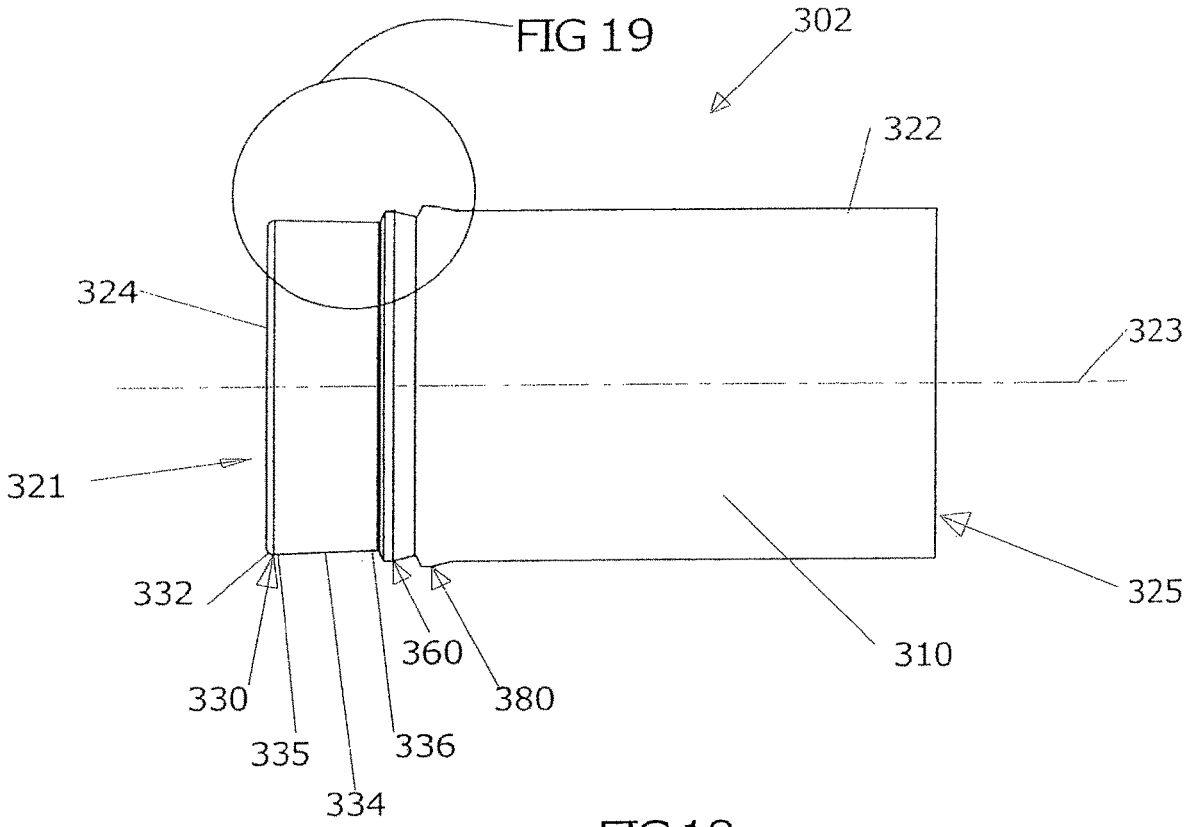
FIG. 18 is a side plan view of a first variant of the extrusion punch of FIG. 13 and useful for impact extrusion of a preform as shown in FIG. 4.
Figure 19:
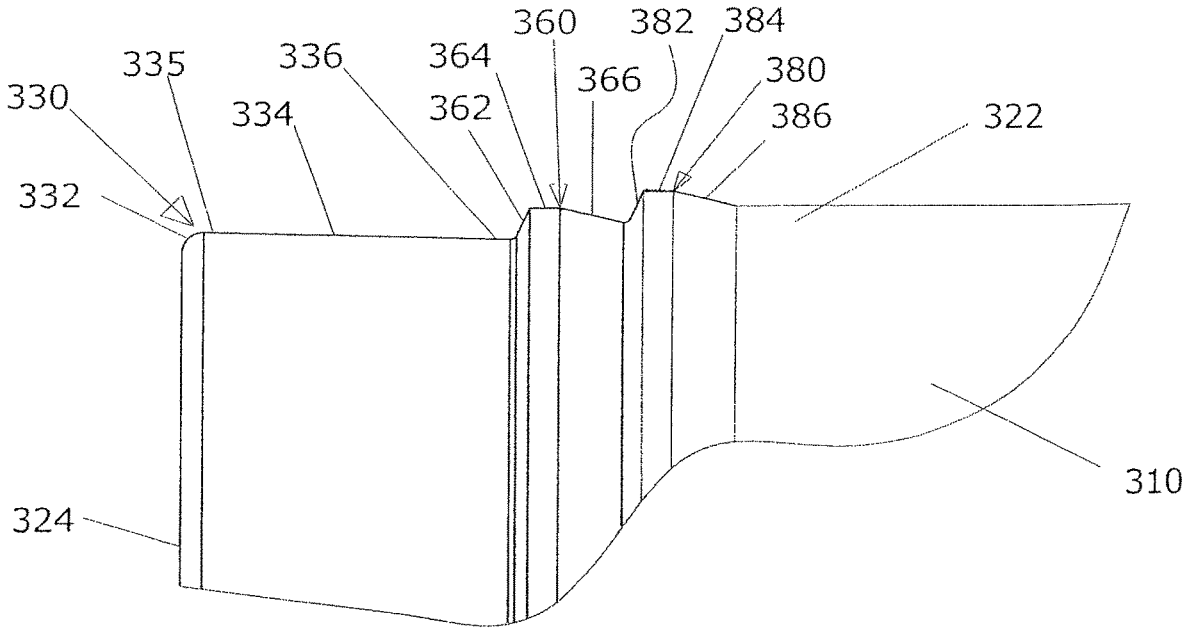
FIG. 19 is a detail cross-sectional view of the first, second and third extrusion points of the first variant extrusion punch shown in FIG. 18.

A variant of the exemplary impact extrusion punch of FIGS. 13 to 17, namely first variant punch 302 is illustrated in detailed view in FIG. 18. Variant extrusion punch 302 includes a body 310 with a central axis 323, an axially forward, impacting end 321 and an axially rearward, driven end 325 for attachment to a driving piston or connecting rod of a press (not shown). The impacting end 321 includes impact surface 324 for impacting the metal slug 30 to be extruded (see FIGS. 1A to 1C). The body 310 further includes a transition region 330, a rear extrusion point 360 axially rearward from the transition region 330 and a thinning extrusion point 380 axially rearward from the rear extrusion point 360. The transition region 330 is formed by a rounded peripheral shoulder 332 of the impact surface 324 and a land portion 334 extending rearward from a forward end 335 at the peripheral shoulder 332 to a rearward end 336. The rear extrusion point 360 is provided for ironing the material redirected by the transition region 330. The rear extrusion point 360 is adjacent the rearward end 336 of the land portion 334. At the forward end 335, the land portion 334 is positioned further from the central axis 323 than at the rearward end 336. The body 310 may have a circular, multi-lobal, or polygonal cross-section. When the body 310 has a circular cross-section, the land portion 334 has a frusto-conical shape with an axially rearwardly decreasing diameter. The axial width of the land portion 334 of variant punch 302 may be selected along the same criteria as used for the land portion 234 of punch 200. As shown in more detail in FIG. 19, the rear extrusion point 360 includes an axially forward extrusion shoulder 362 for ironing the material of the initial sidewall by outwardly extruding the material of the initial sidewall extruded past the forward extrusion point. The extrusion shoulder 362 is followed by a second land portion 364 and a restriction 366 for facilitating removal of the punch from the preform. For advantageous results, the extrusion shoulder 362 may be oriented at a blunt angle to the central axis 323, preferably at an angle of about 10 degrees to about 40 degrees. The thinning extrusion point 380, which is added in the variant punch 302 of FIGS. 18 and 19, includes an axially forward extrusion shoulder 382 for reducing the material thickness of the sidewall ironed by the rear extrusion point 360. The thinning extrusion point 380 outwardly extrudes the material of the ironed sidewall extruded past the rear extrusion point. The thinning extrusion shoulder 382 is followed by a second land portion 384 and a restriction 386 for facilitating removal of the punch from the preform. For advantageous results, the thinning extrusion shoulder 382 may be oriented at a blunt angle to the central axis 323, preferably at an angle of about 10 degrees to about 40 degrees, while the restriction 386 is oriented at an angle of about 1 degree to about 3 degrees to the central axis 323. Using a thinning extrusion point 380 allows for a more stepwise gradual thinning of the sidewall of the preform produced, thereby reducing the puncture rate during deforming of the preform, for example by blow molding.

In other variants of the extrusion punch of the invention, further extrusion points (not illustrated) of the same principal construction as the rear and thinning extrusion points 360, 380 may be added to gradually vary the thickness of the preform produced, which may be advantageous for blow molding of shapes with aggressive shape changes. The extrusion points included in a punch in accordance with the present specification cause an ironing or thinning of the material extruded past the extrusion point, which means an ironing of the material on an inner surface of the material, or an interior surface of the preform.

Figure 20:
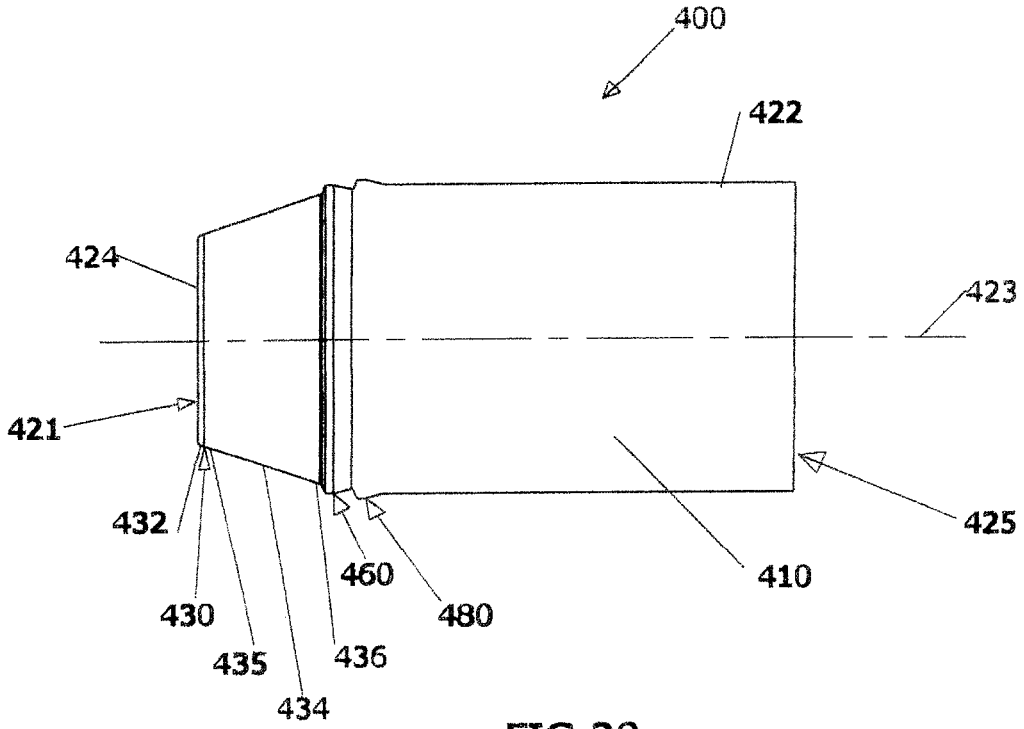
FIG. 20 is a side plan view of a second variant extrusion punch useful for impact extrusion of a preform as shown in FIG. 5.

A second variant extrusion punch 400 as shown in FIG. 20 includes a body 410 with a central axis 423, an axially forward, impacting end 421 and an axially rearward, driven end 425 for attachment to a drive piston or connecting rod of a hydraulic or mechanical press (not shown). The impacting end 421 includes impact surface 424 for impacting the metal slug 30 to be extruded (see FIGS. 1A to 1C). The body 410 includes a transition region 430 and a rear extrusion point 460 axially rearward from the transition region 430 and a thinning extrusion point 480 axially rearward from the rear extrusion point 460. The transition region 430 is formed by a rounded peripheral shoulder 432 of the impact surface 424 and a land portion 434 extending rearward from a forward end 435 at the peripheral shoulder 432 to a rearward end 436. The rear extrusion point 460 is provided for ironing the material plasticized by impact with the impact surface 424 and redirected by the shoulder 432 and land portion 434 of the transition region 430. The rear extrusion point 460 is adjacent the rearward end 436 of the land portion 434. At the forward end 435, the land portion 434 is positioned closer to the central axis 423 than at the rearward end 436. The body 410 may have a circular, multi-lobal, or polygonal cross-section. When the body 410 has a circular cross-section, the land portion 434 has a frusto-conical shape with an axially rearwardly increasing diameter. The land portion 434 has a width in axial direction which may be selected along the same criteria as used for the land portion 234 of punch 200. The rear extrusion point 460 and the thinning extrusion point 480 in the illustrated variant are substantially identical in construction to those shown in FIGS. 18 and 19.

Although the exemplary impact tooling and extrusion punches disclosed above are of circular cross-section for the production of cylindrical preforms, an extrusion punch in accordance with the present invention can also have a cross-section other than circular, such as multilobal or have a regular or irregular geometric cross-section for the generation of multilobal preforms or preforms having a regular or irregular geometric cross-section.

Impact Extrusion with Ironing

An exemplary impact extrusion process in accordance with the present application, for the manufacture of a hollow preform having a longitudinal axis, a closed bottom end, and an axially extending tubular wall of varying thickness includes the following steps. A metal billet is impact extruded by impacting the metal billet to plasticize the metal; redirecting the plasticized material into an axially progressing tubular wall; ironing an axially forward portion of the progressing wall by extruding the forward portion past an extrusion point to form a sidewall portion having a reduced thickness; and stopping the impacting while some of the billet remains unextruded to form the closed bottom end and the tubular wall, the tubular wall including the sidewall portion and a transition wall portion, the transition wall portion extending between the bottom end and the sidewall portion.

In the exemplary process, the impacting is stopped when the metal billet is reduced to a desired bottom wall thickness, the progressing wall is redirected at a transition wall thickness and the sidewall portion is ironed to a sidewall thickness less than the transition wall thickness. The transition wall thickness can be more than, equal to, or less than the bottom wall thickness. In the preform illustrated in FIGS. 3A and 3B, the transition wall thickness 132 is smaller than the bottom wall thickness 122 and larger than the sidewall thickness 112, while in the preform illustrated in FIG. 5, the transition wall thickness 132 is about equal to the bottom wall thickness 122.

In an alternative to the exemplary process, the impacting is stopped when the metal billet is reduced to a bottom wall thickness, the progressing wall is redirected at a sidewall thickness equal to or larger than the bottom wall thickness and the sidewall portion is ironed to a sidewall thickness less than the transition wall thickness.

Advantageously, the ironing of the progressing wall is commenced after a transition length of the progressing wall of about 5 mm to about 15 mm. Preferably, the transition length is about 6 mm to about 10 mm. For preforms of 38 mm diameter, a transition wall portion of about 7 mm to about 9 mm axial width has been found advantageous, which is preferably achieved by commencing the ironing of the progressing wall after a transition length of about 7 mm to about 9 mm.

In another alternative to the exemplary process, the impacting is stopped when the metal billet is reduced to a bottom wall thickness, the progressing wall is redirected at a transition wall thickness equal to or larger than the bottom wall thickness and the sidewall portion is first ironed to a first sidewall thickness less than the transition wall thickness and then ironed to a second sidewall thickness less than the first sidewall thickness, to generate a preform having a bottom wall, a transition wall and a stepped sidewall.

The impacting may be stopped when the metal billet is reduced to a bottom wall thickness of about 0.009 mm to about 0.050 mm, preferably about 0.013 mm to about 0.015 mm.

The force used for impacting of the metal billet is sufficiently high to reliably achieve a plasticizing of the metal in the billet. Suitable force ranges will be apparent to the person of skill in the art. However, when ironing the sidewall as part of the overall impact extrusion process, as in the process of the present application, the impacting force used must also be sufficiently high to permit reliable ironing at the rear extrusion point. Insufficient impacting force may lead to uneven ironing and an uneven thickness of the thinned sidewall of the preform produced, with the potential of cracks forming in the thinned sidewall either during forming of the preform or during expansion of the preform into a shaped container. The inventors have discovered that sufficient impacting pressure for a reliable ironing operation is generated with impact forces of 75-450 tons, in particular forces of about 190 tons to about 210 tons. Reliable ironing was achieved in the manufacture of a 38 mm diameter preform with an impact force of about 200 tons. Higher forces will be required for preforms of larger diameter.

EXAMPLES

Commercially available aluminum slugs made of a Series 1100 or 3000 Alloy, having a 38 mm diameter and 12 mm thickness were impact extruded in a conventional impact extruder press (Schuler Press), using a punch in accordance with the invention as shown in FIG. 20, having a single rear extrusion point. The impacting force used was 200 t. The resulting cylindrical aluminum preform of 38 mm diameter had a closed, flat bottom of about 0.013 mm thickness, a cylindrical sidewall of about 200 mm height and 0.010 mm thickness and a transition wall of about 7 mm width and about 0.013 mm thickness. The preform was subjected to conventional trimming, cleaning and brushing treatments, to generate an even top edge, remove extrusion lubricant and provide an overall even external appearance. The preform was annealed, preheated and pressure ram expanded according to the principal process as disclosed in WO2015/143540, the contents of which are incorporated herein in their entirety.

The fully expanded container which had a diameter of 48 mm was subjected to pressurization up to 90 psi. No deformation or buckling of the bottom end of the container, including the domed bottom and the rim, was observed, nor was any lengthening of the container detected.

The same exemplary extrusion, shaping and testing process was carried out with a preform of 36 mm diameter and a transition wall width of 7 mm, using a punch as shown in FIGS. 13 to 17. Again, no deformation, buckling or lengthening was observed at pressures up to 90 psi. A slight unrolling of the rim of the finished expanded container was observed at 90 psi if a preform of 36 mm and a transition wall width of 5 mm was used. A higher degree of unrolling of the rim was observed when a preform of 36 mm diameter and a transition wall width of 3 mm was used.

The highest degree of unrolling was observed when the transition wall was completely omitted. Thus, inclusion of the transition wall in the expandable preform provides the expanded container made from the preform with improved pressure resistance, while a reliable pressure resistance of up to 90 psi internal pressure in the expanded container is achieved when the transition wall extends over a majority of the rim forming portion. Without being bound by this theory, the inventors believe that providing a thickened annular portion at the bottom end of the tubular wall of the preform results in a rolled-in rim in the pressure ram formed container which has a larger thickness than the sidewall and which will strengthen the inner half of the rim to reduce the chance of rim roll-out. Superior results were achieved with preforms wherein the transition wall extends over the majority of the width of the rim forming portion. For example, in a preform of about 38 mm diameter, a transition wall width of about 7 mm will cover at least half the width of the rim forming portion in an expanded container of about 46 mm formed from this preform.

Although the above description relates to specific preferred embodiments as presently contemplated by the inventors, it will be understood that the invention in its broad aspect includes mechanical and functional equivalents of the elements described herein.

The invention claimed is:

1. A method of impact extruding to produce a hollow metal container preform having a closed bottom end comprising a flat container bottom forming portion with a constant bottom wall thickness and an axially extending tubular wall extending from the closed end and defining a longitudinal axis of the container preform, the method comprising:

(i) impacting a metal slug, a metal billet, or a metal piece of plate material for plasticizing the material of the metal slug, the metal billet, or the metal piece of plate material and displacing and directing the plasticized material for forming an axially progressing tubular transition wall at a transition wall thickness, wherein the impacting is performed by an impact extrusion punch comprising:
- a body with a central axis;
- an axially forward, impacting end;
- an axially rearward, driven end for attachment to a press;
- an impact surface on the impacting end for impacting the metal slug, the metal billet, or the metal piece of plate material to be extruded;
- an annular transition region rearward of the impacting end for directing material displaced by the impact surface; and
- a rear extrusion point for ironing material directed past the transition region, the rear extrusion point being adjacent a rearward end of the transition region and comprising an extrusion shoulder for ironing the material directed past the transition region, the extrusion shoulder extending outward from the rearward end of the transition region to a larger spacing from the central axis than the rearward end and extending at an angle of about 10 degrees to about 40 degrees to the central axis;

(ii) ironing an axially forward portion of the progressing transition wall on a radially inner surface by forcing the axially forward portion of the progressing transition wall past an extrusion point to form an axially progressing tubular sidewall having a sidewall thickness smaller than the transition wall thickness, the ironing of the axially forward portion of the progressing transition wall being performed by an extrusion shoulder of the extrusion point; and (iii) stopping the impacting and ironing while some of the metal slug, the metal billet, or the metal piece of plate material remains, to form the closed bottom end with the bottom forming portion being configured to form, via a fluid pressure forming process, a closed bottom of a finished expanded metal container.

2. The method of claim 1, wherein the metal slug, the metal billet, or the metal piece of plate material is made or aluminum or aluminum alloy.

3. The method of claim 1, wherein the impacting and ironing is stopped when the metal slug, the metal billet, or the metal piece of plate material is reduced to a bottom wall thickness about equal to or larger than the transition wall thickness.

4. The method of claim 3, wherein the metal slug, the metal billet, or the metal piece of plate material is made of aluminum or aluminum alloy.

5. The method of claim 1, wherein the ironing of the axially forward portion of the progressing transition wall is commenced after an axial progression of the progressing transition wall of 5 mm to 15 mm or an axial progression of the progressing transition wall of 5% to 80% of a spacing of the progressing transition wall from the longitudinal axis.

6. The method of claim 5, wherein the metal slug, the metal billet, or the metal piece of plate material is made of aluminum or aluminum alloy.

7. The method of claim 5, wherein the ironing of the progressing transition wall is commenced after an axial progression of 6 mm to 10 mm.

8. The method of claim 5, wherein the ironing of the progressing transition wall is commenced after an axial progression of 30% to 53% of the spacing of the progressing transition wall from the longitudinal axis.

9. The method of claim 5, wherein the ironing of the progressing transition wall is commenced after an axial progression of 7 mm to 9 mm.

10. The method of claim 5, wherein the ironing of the progressing transition wall is commenced after an axial progression of 36% to 47% of the spacing of the progressing transition wall from the longitudinal axis.

11. The method of claim 5, wherein the spacing of the progressing transition wall from the longitudinal axis is about-18 mm.

12. The method of claim 11, wherein the metal slug, the metal billet, or the metal piece of plate material is made of aluminum or aluminum alloy.

13. The method of claim 5, wherein the ironing of the progressing transition wall is commenced after an axial progression of about 7 mm.

14. The method of claim 5, wherein the ironing of the progressing transition wall is commenced after an axial progression of about 36% of the spacing of the progressing transition wall from the longitudinal axis.

15. The method of claim 5, wherein the spacing of the progressing transition wall from the longitudinal axis is about 19 mm.

16. The method of claim 15, wherein the metal slug, the metal billet, or the metal piece of plate material is made of aluminum or aluminum alloy.

17. The method of claim 5, wherein the ironing of the progressing transition wall is commenced after an axial progression of about 9 mm.

18. The method of claim 5, wherein the ironing of the progressing transition wall is commenced after an axial progression of about 47% of the spacing of the progressing transition wall from the longitudinal axis.

* * * * *